US011206870B1

(12) United States Patent
Yamada et al.

(10) Patent No.: US 11,206,870 B1
(45) Date of Patent: Dec. 28, 2021

(54) NON-COMBUSTION SUCTION DEVICE

(71) Applicant: JAPAN TOBACCO INC., Tokyo (JP)

(72) Inventors: Manabu Yamada, Tokyo (JP); Akihiro Sugiyama, Tokyo (JP); Yutaka Kaihatsu, Tokyo (JP); Keisuke Morita, Tokyo (JP); Keisuke Haruki, Tokyo (JP); Yuko Nishida, Nagoya (JP); Hirokazu Watanabe, Nagoya (JP); Takayuki Aoyama, Nagoya (JP); Motoo Nakano, Nagoya (JP)

(73) Assignee: JAPAN TOBACCO INC., Tokyo (JP)

( * ) Notice: Subject to any disclaimer, the term of this patent is extended or adjusted under 35 U.S.C. 154(b) by 0 days.

(21) Appl. No.: 17/120,824

(22) Filed: Dec. 14, 2020

Related U.S. Application Data

(63) Continuation of application No. 17/060,097, filed on Oct. 1, 2020, now abandoned, which is a continuation of application No. PCT/JP2020/025599, filed on Jun. 30, 2020.

(51) Int. Cl.
*A24F 40/46* (2020.01)
*A24F 40/42* (2020.01)
*A24F 40/44* (2020.01)

(52) U.S. Cl.
CPC ..... *A24F 40/46* (2020.01); *A24F 40/42* (2020.01); *A24F 40/44* (2020.01)

(58) Field of Classification Search
CPC ..... A24F 40/46
See application file for complete search history.

(56) References Cited

U.S. PATENT DOCUMENTS

| | | | | |
|---|---|---|---|---|
| 2016/0206004 | A1* | 7/2016 | Shinkawa | H05B 3/0014 |
| 2016/0256807 | A1 | 9/2016 | Gao et al. | |
| 2017/0188626 | A1* | 7/2017 | Davis | A24F 40/40 |
| 2020/0128875 | A1* | 4/2020 | Cane | A24F 40/46 |

FOREIGN PATENT DOCUMENTS

| | | | |
|---|---|---|---|
| CN | 110074469 | A | 8/2019 |
| EP | 3 042 577 | A1 | 7/2016 |
| JP | 05-283147 | A | 10/1993 |
| JP | 2000-340349 | A | 12/2000 |

(Continued)

OTHER PUBLICATIONS

International Search Report dated Sep. 15, 2020 in International Patent Application No. PCT/JP2020/025599, 6 pages.

*Primary Examiner* — Anthony Calandra
(74) *Attorney, Agent, or Firm* — Xsensus LLP

(57) ABSTRACT

A non-combustion suction device includes: a mouthpiece having a suction port; a container configured to accommodate an aerosol source; and a heater including: a porous ceramic substrate that permits infiltration of the aerosol source; a glass layer at least in part on the porous ceramic substrate; a pair of electrode patterns; and a resistor pattern on the glass substrate, the resistor pattern connects the pair of electrode patterns to each other; and a power source connected to the pair of electrode patterns. The power source is configured to supply a power flow through the pair of electrode patterns to cause the resistor pattern to generate heat which atomize, into an aerosol, the aerosol source infiltrated in the porous ceramic substrate; and the porous ceramic substrate has a ratio of porosity to tortuosity of 21 or more.

10 Claims, 19 Drawing Sheets

(56) References Cited

FOREIGN PATENT DOCUMENTS

| | | | |
|---|---|---|---|
| JP | 2004-524073 | A | 8/2004 |
| JP | 5685152 | B2 | 3/2015 |
| JP | 2019-506896 | A | 3/2019 |
| JP | 2019-523742 | A | 8/2019 |
| WO | 02/051469 | A2 | 7/2002 |
| WO | 2015/046385 | A1 | 4/2015 |
| WO | 2017/118927 | A1 | 7/2017 |
| WO | 2017/210251 | A1 | 12/2017 |

* cited by examiner

FIG. 17

| | SUBSTRATE | | | GLASS LAYER | | RESISTOR PATTERN | | MEASUREMENT RESULT | |
|---|---|---|---|---|---|---|---|---|---|
| | CONDUCTIVITY | AVERAGE PORE SIZE (μm) | POROSITY (%) | THICKNESS (μm) | WIDTH (RESISTOR PATTERN RATIO) (%) | THICKNESS (μm) | RESISTANCE VALUE (Ω) | ATOMIZATION AMOUNT (mg) | HEATING CYCLE |
| COMPARATIVE PRODUCT 1 | ABSENCE | – | 0 | 20 | 133 | 10 | 2 | 0.5 | GOOD |
| COMPARATIVE PRODUCT 2a | ABSENCE | 3.3 | 65 | – | – | 10 | 2 | 6.5 | BAD |
| COMPARATIVE PRODUCT 2b | PRESENCE | 3.3 | 65 | – | – | 10 | 2 | 0.8 | GOOD |
| EXAMPLE PRODUCT 1 | ABSENCE | 3.3 | 65 | 20 | 133 | 10 | 2 | 6.3 | GOOD |
| EXAMPLE PRODUCT 2a | ABSENCE | 1.5 | 65 | 20 | 133 | 10 | 2 | 5.2 | GOOD |
| EXAMPLE PRODUCT 2b | ABSENCE | 1.5 | 60 | 20 | 133 | 10 | 2 | 4.2 | GOOD |
| EXAMPLE PRODUCT 2b | ABSENCE | 1.5 | 57 | 20 | 133 | 10 | 2 | 3.4 | GOOD |
| EXAMPLE PRODUCT 3a | ABSENCE | 1.5 | 65 | 20 | 133 | 10 | 2 | 5.4 | GOOD |
| EXAMPLE PRODUCT 1 | ABSENCE | 3.3 | 65 | 20 | 133 | 10 | 2 | 6.3 | GOOD |
| EXAMPLE PRODUCT 3b | ABSENCE | 4.2 | 65 | 20 | 133 | 10 | 2 | 6.9 | GOOD |
| EXAMPLE PRODUCT 3c | ABSENCE | 5.1 | 65 | 20 | 133 | 10 | 2 | 7.1 | GOOD |
| EXAMPLE PRODUCT 3d | ABSENCE | 72 | 58 | 20 | 133 | 10 | 1.3 | 7.2 | GOOD |
| EXAMPLE PRODUCT 3e | ABSENCE | 0.15 | 65 | 20 | 133 | 10 | 1.3 | 4.2 | GOOD |
| EXAMPLE PRODUCT 4a | ABSENCE | 3.3 | 65 | 22 | 133 | 10 | 2 | 6.3 | GOOD |
| EXAMPLE PRODUCT 1 | ABSENCE | 3.3 | 65 | 20 | 133 | 10 | 2 | 6.3 | GOOD |
| EXAMPLE PRODUCT 4b | ABSENCE | 3.3 | 65 | 19 | 133 | 10 | 2 | 6.3 | GOOD |
| EXAMPLE PRODUCT 4c | ABSENCE | 3.3 | 65 | 17 | 133 | 10 | 2 | 6.3 | GOOD |
| EXAMPLE PRODUCT 4d | ABSENCE | 3.3 | 65 | 90 | 133 | 10 | 2 | 6 | GOOD |
| EXAMPLE PRODUCT 4e | ABSENCE | 3.3 | 65 | 3 | 133 | 10 | 2 | 6.5 | GOOD |
| EXAMPLE PRODUCT 5a | ABSENCE | 3.3 | 65 | 20 | 133 | 8 | 1.5 | 6 | GOOD |
| EXAMPLE PRODUCT 5b | ABSENCE | 3.3 | 65 | 20 | 133 | 17 | 1.5 | 6 | GOOD |
| EXAMPLE PRODUCT 5c | ABSENCE | 3.3 | 65 | 20 | 133 | 21 | 1.5 | 6 | GOOD |
| EXAMPLE PRODUCT 6a | ABSENCE | 3.3 | 65 | 20 | 133 | 17 | 1.5 | 6 | GOOD |
| EXAMPLE PRODUCT 6b | ABSENCE | 3.3 | 65 | 20 | 133 | 17 | 2 | 6.3 | GOOD |
| EXAMPLE PRODUCT 6c | ABSENCE | 3.3 | 65 | 20 | 133 | 17 | 2.7 | 6.7 | GOOD |
| EXAMPLE PRODUCT 7a | ABSENCE | 3.3 | 65 | 20 | 133 | 10 | 1.3 | 6.3 | GOOD |
| EXAMPLE PRODUCT 7b | ABSENCE | 3.3 | 65 | 20 | 167 | 10 | 1.3 | 6.1 | GOOD |
| EXAMPLE PRODUCT 7c | ABSENCE | 3.3 | 65 | 20 | 200 | 10 | 1.3 | 5.8 | GOOD |
| EXAMPLE PRODUCT 7d | ABSENCE | 3.3 | 65 | 20 | 233 | 10 | 1.3 | 5 | GOOD |
| EXAMPLE PRODUCT 7e | ABSENCE | 3.3 | 65 | 20 | 267 | 10 | 1.3 | 4.3 | GOOD |
| EXAMPLE PRODUCT 7f | ABSENCE | 3.3 | 65 | 20 | 300 | 10 | 1.3 | 3.8 | GOOD |
| EXAMPLE PRODUCT 7g | ABSENCE | 3.3 | 65 | 20 | 100 | 10 | 1.3 | 6.5 | GOOD |
| EXAMPLE PRODUCT 8 | PRESENCE | 3.3 | 65 | 20 | 133 | 10 | 2 | 5.9 | GOOD |

FIG. 18

| | SUBSTRATE | | | GLASS LAYER | | RESISTOR PATTERN | | MEASUREMENT RESULT | | | |
|---|---|---|---|---|---|---|---|---|---|---|---|
| | CONDUCTIVITY | AVERAGE PORE SIZE (μm) | POROSITY (%) | THICKNESS (μm) | WIDTH (RESISTOR PATTERN RATIO) (%) | THICKNESS (μm) | RESISTANCE VALUE (Ω) | ATOMIZATION AMOUNT (mg) | HEATING CYCLE | TORTUOSITY COEFFICIENT | POROSITY / TORTUOSITY COEFFICIENT RATIO |
| EXAMPLE PRODUCT 9a | ABSENCE | 26 | 66 | 20 | 133 | 10 | 1.3 | 7.8 | GOOD | 1.32 | 50 |
| EXAMPLE PRODUCT 9b | ABSENCE | 9.8 | 40 | 20 | 133 | 10 | 1.1 | 3.1 | GOOD | 1.94 | 20.6 |
| EXAMPLE PRODUCT 9c | ABSENCE | 4 | 65 | 20 | 133 | 10 | 1.4 | 7 | GOOD | 1.47 | 44 |
| EXAMPLE PRODUCT 9d | ABSENCE | 4.1 | 66 | 20 | 133 | 10 | 1.4 | 6.4 | GOOD | 1.67 | 39.5 |
| EXAMPLE PRODUCT 9e | ABSENCE | 13 | 71 | 20 | 133 | 10 | 1.3 | 8.1 | GOOD | 1.17 | 60.7 |
| COMPARATIVE PRODUCT 9 | ABSENCE | 1.13 | 38 | 20 | 133 | 10 | 1.4 | 1.6 | BAD | 2.28 | 16.7 |

NON-COMBUSTION SUCTION DEVICE

CROSS REFERENCE TO RELATED APPLICATIONS

This application is a continuation application based on a U.S. patent application Ser. No. 17/060,097, filed on Oct. 1, 2020, and a PCT Patent Application No. PCT/JP2020/025599, filed on Jun. 30, 2020, the contents of which are incorporated herein by reference.

BACKGROUND

Technical Field

The present invention relates to a non-combustion suction device.

Background Art

Conventionally, a non-combustion suction device (hereinafter sometimes simply referred to as a suction device) that tastes a flavor by aspirating an aerosol atomized by heating has been known. As this kind of suction device, there is, for example, the suction device that includes a cartridge in which an atomizable content (for example, an aerosol source) is stored and a power supply unit in which a storage battery is mounted.

In the suction device, a heater generates heat by the electric power supplied from the storage battery. As a result, the contents in the cartridge are atomized. The user can suck the atomized aerosol together with the air through a suction port part. For example, Published Japanese Translation No. 2004-524073 of the PCT International Publication describes an aerosol generator that generates an aerosol.

Here, the heater provided with a resistor pattern and a pair of electrode patterns connected to the resistor pattern on one surface of the porous ceramic substrate is known. As an example for improving the durability performance for the heater, it is proposed that a resistance heating element and a lead wire are embedded inside an insulating ceramic substrate, and the material and the film thickness of the resistance heating element and the lead wire are optimized (See Japanese Unexamined Patent Application, First Publication No. 2000-340349). However, for the purpose to atomize the aerosol source, a heater using a dense ceramic substrate, it is difficult to continuously supply the aerosol source, and good atomization efficiency cannot be obtained.

On the other hand, in order to obtain good atomization efficiency, it has been proposed that a porous body is used as a substrate or a heating element, an aerosol source is directly and continuously supplied to the heating part by a capillary phenomenon, and the aerosol source infiltrated into the porous body is quickly atomized. For example, the porous heating element described in Japanese Patent (Granted) Publication No. 5685152. According to this porous heating element, the porous heating element is constituted with a porous body whose main raw material is aluminum and the porous body itself is an electric resistance heating element that generates heat.

According to the above-described porous heating element, the porous body itself must be a conductive substance, and particularly when used for the purpose of atomizing the liquid, there is a problem that it is difficult to achieve both chemical resistance and mechanical strength against the liquid depending on the application.

It is also conceivable to form a heating element on one surface of an insulating porous body such as ceramics. In this case, multiple types of ceramic materials can be used for the porous body, increasing the material selectivity of the substrate. However, since the electric resistance heating element formed on the uneven surface of the porous body is not uniform in thickness and locally differs, there are problems that the thermal shock resistance is low and the adhesive strength between the substrate and the electric resistance heating element is low.

SUMMARY

An embodiment of the present invention provides a non-combustion suction device including a heater that can obtain high atomization efficiency and durability when used for the purpose of atomizing a liquid.

According to an aspect of the present invention, a non-combustion suction device incudes: a mouthpiece having a suction port; a container configured to accommodate an aerosol source; and a heater including: a porous ceramic substrate that permits infiltration of the aerosol source; a glass layer at least in part on the porous ceramic substrate; a pair of electrode patterns; and a resistor pattern on the glass substrate, the resistor pattern connects the pair of electrode patterns to each other; and a power source connected to the pair of electrode patterns. The power source is configured to supply a power flow through the pair of electrode patterns to cause the resistor pattern to generate heat which atomize, into an aerosol, the aerosol source infiltrated in the porous ceramic substrate; and the porous ceramic substrate has a ratio of porosity to tortuosity of 21 or more.

According to an aspect of the present invention, in the non-combustion suction device, the ratio of porosity to tortuosity of the porous ceramic substrate may be 26 or more.

According to an aspect of the present invention, in the non-combustion suction device, the porous ceramic substrate may have an average porosity of 40% by volume to 71% by volume.

According to an aspect of the present invention, in the non-combustion suction device, a tortuosity coefficient of pores of the porous ceramic substrate may be 2.0 or less.

According to an aspect of the present invention, in the non-combustion suction device, the porous ceramic substrate may have an average pore size of 0.15 μm to 72 μm.

According to an aspect of the present invention, in the non-combustion suction device, the glass layer may have a thickness of 3 μm to 90 μm.

According to an aspect of the present invention, in the non-combustion suction device, the glass layer may be composed of a sintered body of a thick film glass paste on the one surface of the porous ceramic substrate. The resistor pattern may be composed of a sintered body of a thick film resistor paste on the glass layer. The electrode pattern may be made of a sintered body of a thick film conductive paste provided on the glass layer.

According to an aspect of the present invention, in the non-combustion suction device, the porous ceramic substrate may contain at least one of alumina, zirconia, mullite, silica, titania, silicon nitride, silicon carbide, and carbon, as a main component. The resistor pattern may be a thick film sintered body containing glass, and a metal powder of at least one of silver, palladium, and ruthenium oxide. The electrode pattern may be a thick film sintered body containing grass, and a metal powder of at least one of copper, nickel, aluminum, silver, platinum, and gold. The glass layer may be a thick film sintered body containing at least one of barium, boron, and zinc.

According to an aspect of the present invention, in the non-combustion suction device, a surface of the porous ceramic substrate may be a longitudinal-shape surface. The pair of electrode patterns may be arranged at both ends of the longitudinal-shape surface. In the resistor pattern, first ends of a pair of U-shaped arcs may be connected to each other and each of second ends of the pair of U-shaped arcs may be connected to each of the pair of electrode patterns.

According to an aspect of the present invention, in the non-combustion suction device, the suction port part may include a flavor source container.

According to an aspect of the present invention, in the non-combustion suction device, the flavor source container may contain a tobacco component.

According to the non-combustion suction device of an embodiment of the present invention, the ratio of porosity to tortuosity of the porous ceramic substrate is 21 or more. A resistor pattern is provided at a surface of the porous ceramic substrate via a glass layer. The glass layer is formed in at least a part of the surface at which the resistor pattern to be provided. Thereby, the thermal shock resistance and adhesive strength of the electric resistance heating element are improved, and high durability performance can be obtained. Further, since the aerosol source that has infiltrated into the porous ceramic substrate is atomized by heating with the resistor pattern, high atomization efficiency can be obtained.

The ratio of porosity to tortuosity of the porous ceramic substrate may be 26 or more. Thereby, since the heater is provided with pores having a high porosity and a small bend, high atomization performance can be obtained. In a case in which the ratio of porosity to tortuosity is less than 26, the porosity may be too low or the pores may have many bends, resulting in insufficient penetration of the aerosol source, making it difficult to obtain sufficient atomization performance.

The porous ceramic substrate may have an average porosity of 40% by volume to 71% by volume. This facilitates the infiltration of the aerosol source into the porous ceramic substrate, thus improving the atomization efficiency of the aerosol source, that is, the atomization performance. In a case in which the porosity exceeds 71% by volume, it becomes difficult to obtain sufficient durability of the heater due to peeling of the glass layer, the resistor pattern, or the electrode pattern. In a case in which the porosity is less than 40% by volume, it becomes difficult to obtain sufficient atomization performance.

The tortuosity coefficient of the pores of the porous ceramic substrate may be 2.0 or less. Thereby, since the heater has pores with a small bend, high atomization performance can be obtained. In a case in which the coefficient of tortuosity exceeds 2.0, the infiltration resistance of the aerosol source may increase and the infiltration of the aerosol source may become insufficient, making it difficult to obtain sufficient atomization performance.

The porous ceramic substrate may have an average pore size of 0.15 μm to 72 μm. This facilitates the infiltration of the aerosol source into the porous ceramic substrate by the capillary action, so that the atomization efficiency of the aerosol source, that is, the atomization performance is improved. In a case in which the average pore size is less than 0.15 μm, the infiltration resistance of the aerosol source increases and the infiltration of the aerosol source becomes insufficient. In a case in which the average pore size exceeds 72 μm, the capillary force may decrease due to the capillary phenomenon and the infiltration of the aerosol source may become insufficient, which makes it difficult to obtain sufficient atomization performance.

The glass layer may have a thickness of 3 μm to 90 μm. In a case in which the thickness of the glass layer is less than 3 μm, the resistance value of the resistor pattern varies and the manufacturing yield decreases. In a case in which it exceeds 90 μm, the heat conduction from the resistor pattern to the porous ceramic substrate decreases, and it becomes difficult to obtain sufficient atomization performance.

The glass layer may be composed of a sintered body of a thick film glass paste provided on one surface of the porous ceramic substrate, the resistor pattern may be composed of a sintered body of a thick film resistor paste provided on the glass layer, and the electrode pattern may be formed of a sintered body of a thick film conductive paste provided on the glass layer. Thereby, since the glass layer and the resistor pattern and the electrode pattern on the glass layer are formed by the thick film on one surface of the porous ceramic substrate, thermal shock resistance and adhesive strength is obtained, and durability is obtained.

The porous ceramic substrate may be mainly composed of at least one of alumina, zirconia, mullite, silica, titania, silicon nitride, silicon carbide, and carbon, and the resistor pattern may be a thick film sintered body containing a metal powder of at least on of silver, palladium, and ruthenium oxide, and glass. The electrode pattern may be a thick film sintered body containing a metal powder of at least one of copper, nickel, aluminum, silver, platinum, and gold, and glass, and the glass layer may be a thick film sintered body containing at least one of Ba, B, and Zn. Since the glass layer and the resistor pattern and the electrode pattern on the glass layer are formed by the thick film sintered body on one surface of the porous ceramic substrate, the thermal shock resistance and the adhesion are improved, and the strength and durability are obtained.

One surface of the porous ceramic substrate may be a longitudinal-shape surface, the pair of electrode patterns may be arranged at both ends of the longitudinal-shape surface. In the resistor pattern, one ends of the pair of U-shaped portions may be connected to each other and the other end may be connected to each of the pair of electrode patterns. The resistor pattern has a shape in which one ends of the pair of U-shaped portions are connected to each other and the tip ends extending from the other ends are connected to the pair of electrode patterns, respectively. Thereby, the heat is not locally concentrated and the entire resistor pattern is uniformly heated, and the atomization efficiency of the aerosol source, that is, the atomization performance is improved.

The suction port part may be provided with a flavor source container. The flavor can be added to the aerosol by arranging the flavor source in the suction port part.

The flavor source container may contain a tobacco component. The tobacco flavor can be added to the aerosol by including the tobacco component in the flavor source.

BRIEF DESCRIPTION OF THE DRAWINGS

FIG. 17 is a chart showing the contents of test products used in the atomization experiment conducted by the present inventors and the experimental results, wherein the test products in which one of porosity, average pore size, glass layer thickness, resistor pattern area, resistor pattern thickness, resistor pattern resistance value, and electrode pattern area is changed.

FIG. 18 is a table showing the contents and experimental results of the test products used in the atomization experiments conducted by the inventors of the present invention with respect to the test products in which the width of the glass layer and the width with respect to the resistor pattern match.

DETAILED DESCRIPTION OF THE PREFERRED EMBODIMENT

An embodiment of the present invention will be described with reference to the drawings.

(Suction Device)

Figure 1:
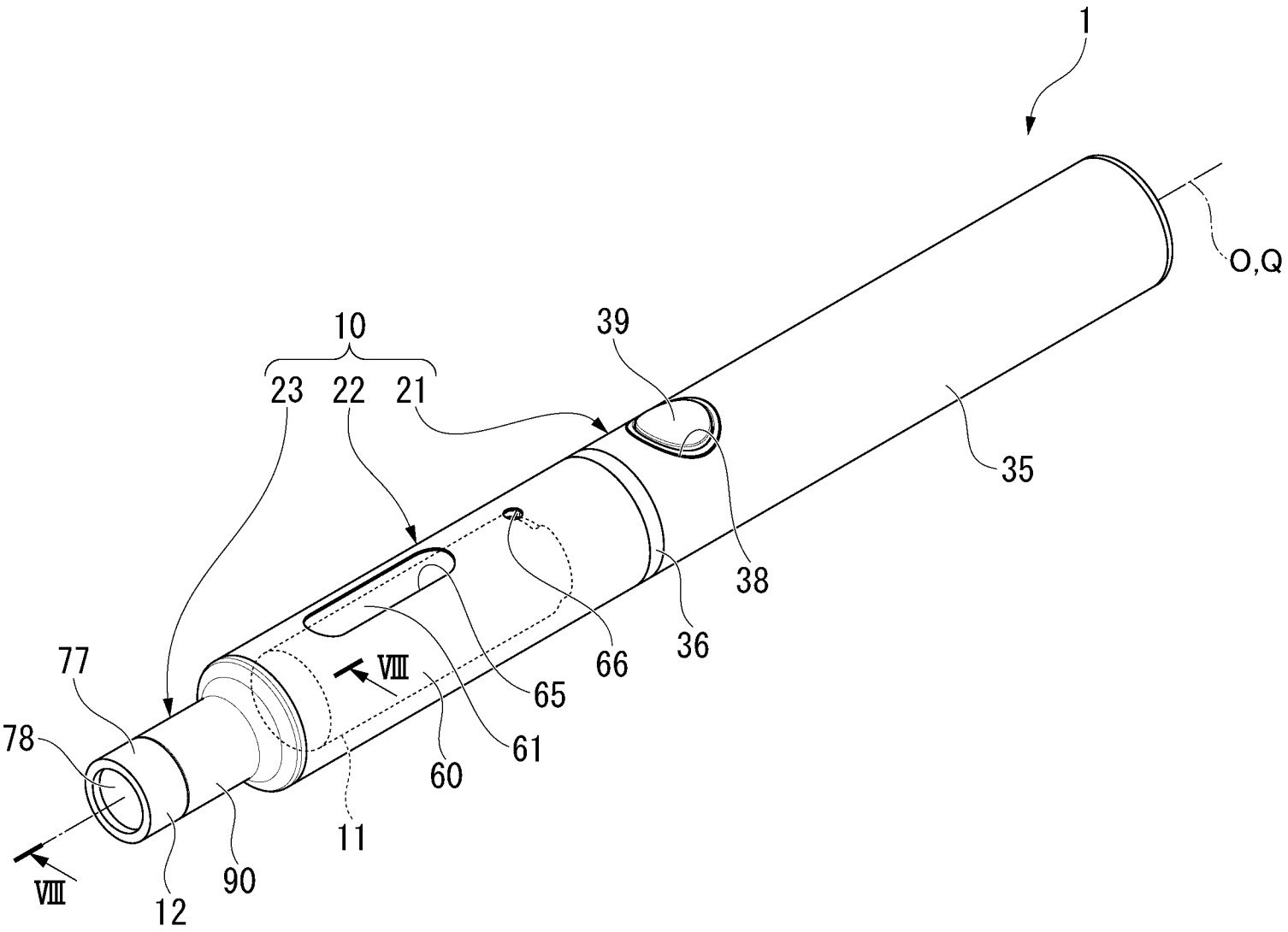
FIG. 1 is a perspective view of a suction device according to an embodiment.

FIG. 1 is a perspective view of a suction device.

The suction device 1 shown in FIG. 1 is a so-called non-combustion suction device, in which a user tastes the flavor of tobacco by inhaling aerosol atomized by heating through a tobacco (tobacco capsule).

The suction device 1 includes a main body unit 10, and a cartridge 11 and a tobacco capsule 12 that are detachably attached to the main body unit 10.

(Main Body Unit)

Figure 2:
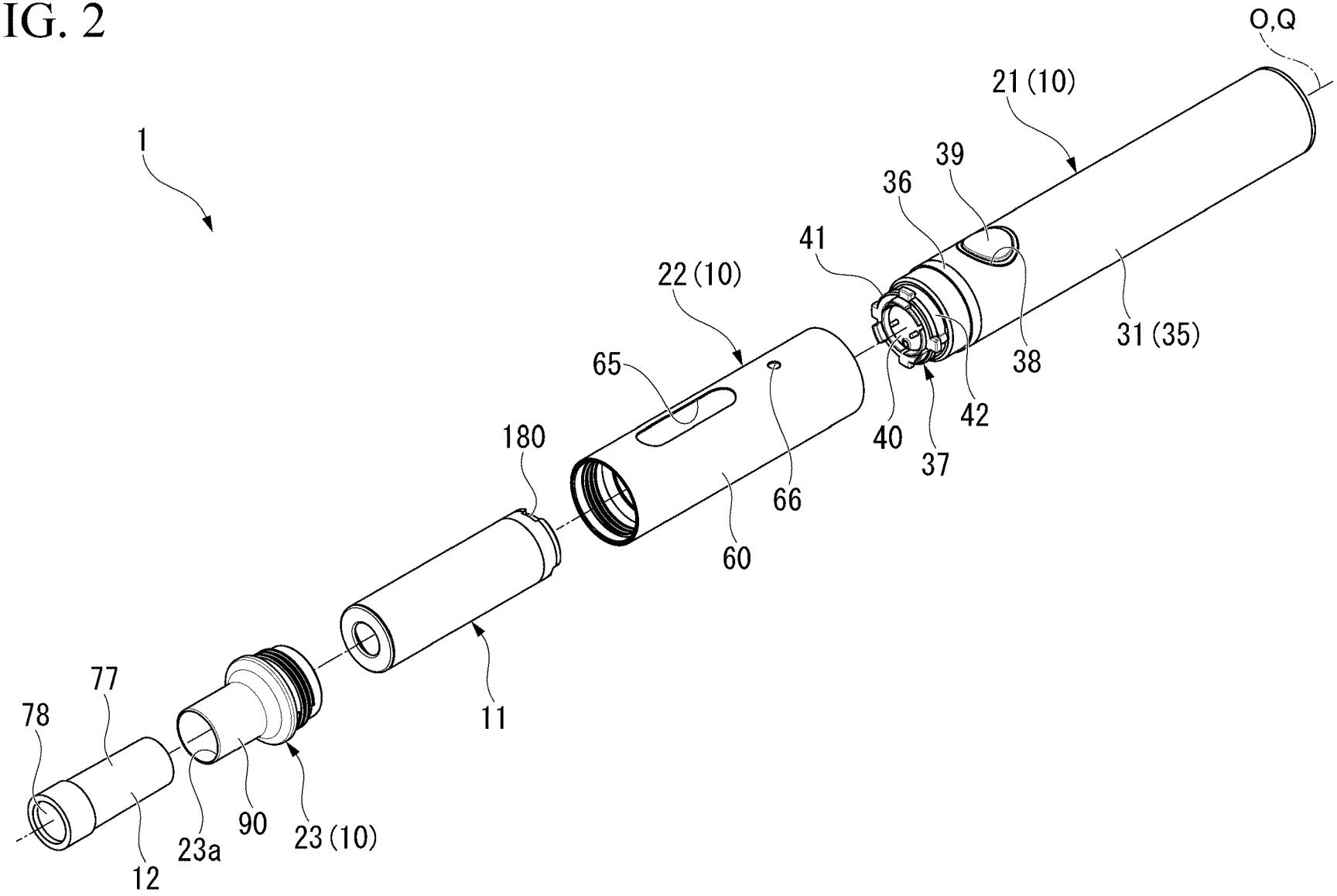
FIG. 2 is an exploded perspective view of the suction device according to the embodiment.

FIG. 2 is an exploded perspective view of the suction device 1.

As shown in FIG. 2, the main body unit 10 includes a power supply unit (power supply) 21, a holding unit (container) 22, and a mouthpiece 23. The power supply unit 21, the holding unit 22, and the mouthpiece 23 are each formed in a tubular shape with the axis O as a central axis, and are arranged in line with the axis O. The power supply unit 21 and the holding unit 22 are detachably connected, and the holding unit 22 and the mouthpiece 23 are detachably connected.

In the following description, the direction along the axis O is referred to as the axial direction. In addition, a direction intersecting the axis O in a plan view seen from the axial direction may be referred to as a radial direction, and a direction around the axis O may be referred to as a circumferential direction. In this specification, "direction" means two directions, and when indicating one of the "directions", it is referred to as "side". In this case, a direction from the mouthpiece 23 toward the power supply unit 21 in the axial direction is called the non-suction side, and a direction from the power supply unit 21 toward the mouthpiece 23 is called the suction side.

(Power Supply Unit)

Figure 3:
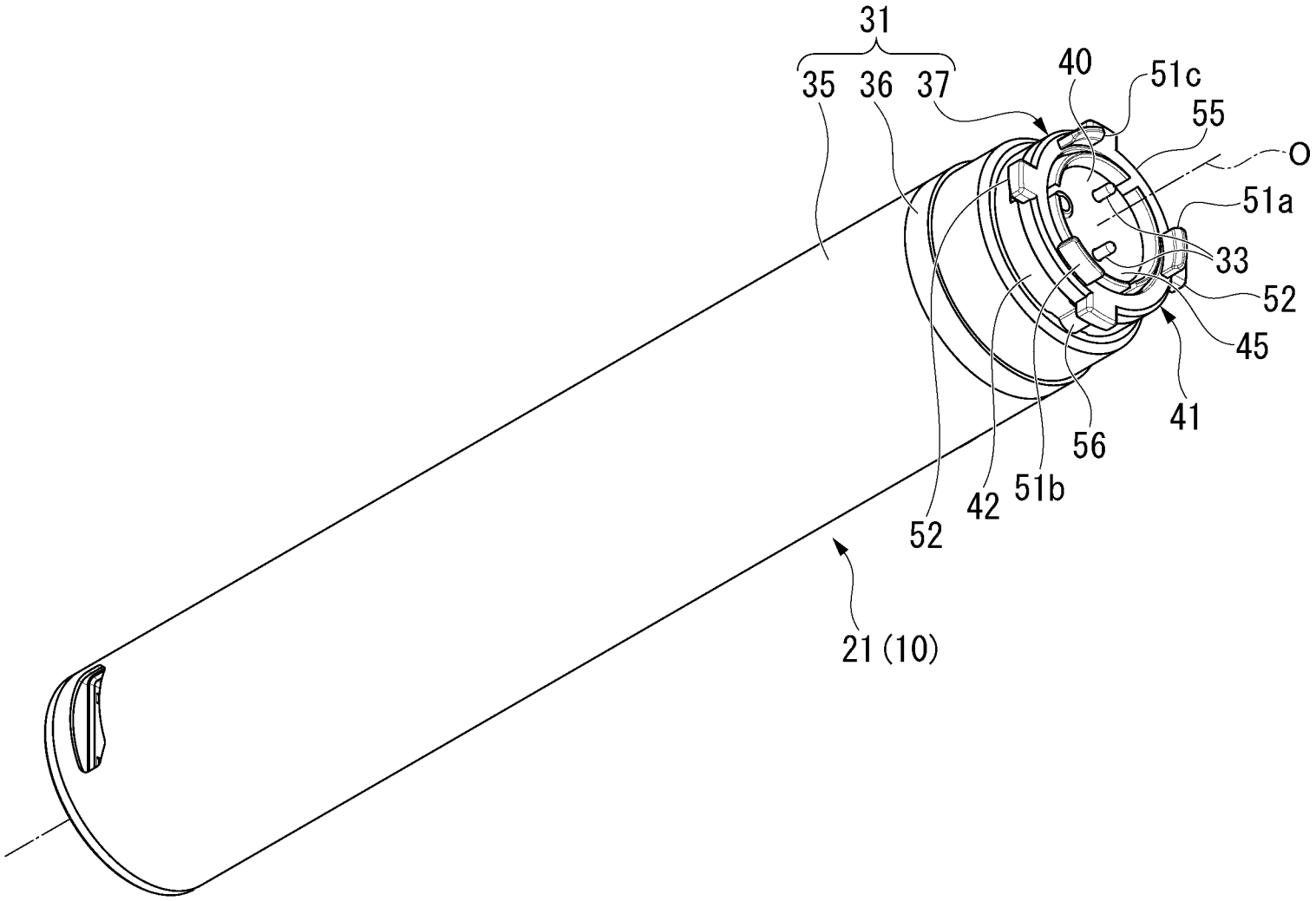
FIG. 3 is a perspective view of a power supply unit according to the embodiment.

FIG. 3 is a perspective view of the power supply unit 21.

As shown in FIGS. 2 and 3, the power supply unit 21 includes a cylindrical housing 31, a storage battery unit (not shown) housed in the housing 31, and a pin electrode 33.

(Housing)

As shown in FIGS. 2 and 3, the housing 31 has an exterior cylindrical portion 35, an interposition member 36, and a connecting mechanism 37.

The exterior tubular portion 35 is formed in a cylindrical shape with the axis O as the central axis. The interposition member 36 is formed in a cylindrical shape with the axis O as the central axis. The interposition member 36 is fitted into the exterior tubular portion 35 from the holding unit 22 side in the axial direction.

A button exposure hole 38 is formed in the vicinity of the end portion of the outer tubular portion 35 on the holding unit 22 side in the axial direction. The button exposure hole 38 penetrates the exterior tubular portion 35 in the radial direction. A button 39 is housed in the button exposure hole 38. The button 39 is configured to be movable in the radial direction. The button 39 presses a switch element (not shown) of the storage battery unit as it moves inward in the radial direction. By pressing the button 39 and turning on the power, a temperature of the resistor pattern 142 of the heater 104 rises. As a result, the aerosol source is atomized to generate aerosol. The configuration of the heater 104 will be described later. The surface of the button 39 is exposed on the outer peripheral surface of the exterior tubular portion 35 through the button exposure hole 38. The button 39 is not limited to the one that moves in the radial direction, but may be one that slides in the axial direction, for example. Further, the suction device 1 may be operated by a touch sensor or the like instead of the button 39.

(Connecting Mechanism)

Figure 4:
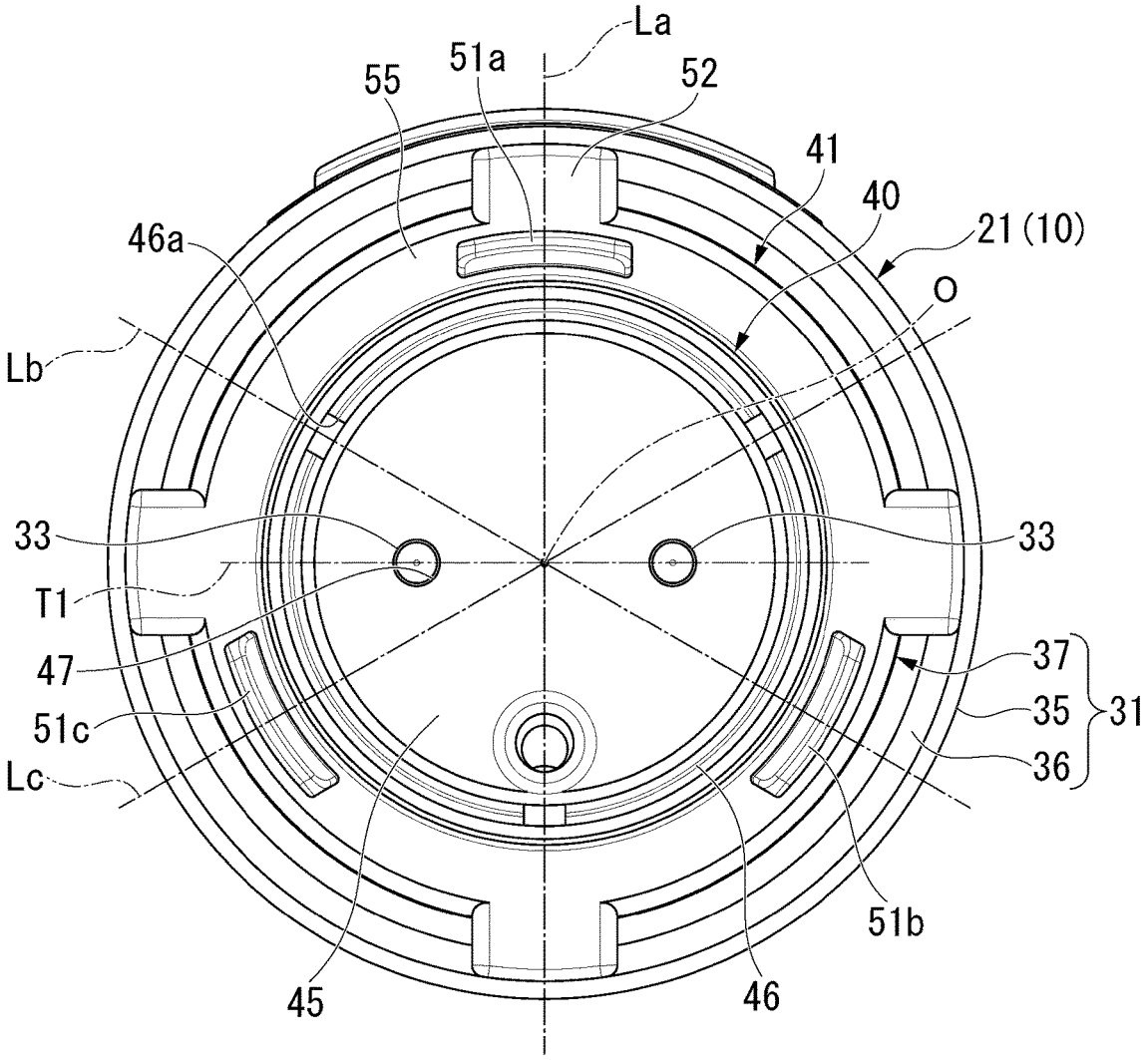
FIG. 4 is a plan view of the power supply unit according to the embodiment as seen from the holding unit side in the axial direction.

FIG. 4 is a plan view of the power supply unit 21 viewed from the holding unit 22 side in the axial direction.

As shown in FIGS. 2 to 4, the connecting mechanism 37 includes a connection cap 40, a first connecting member 41, and an annular piece 42.

The connection cap 40 is formed of an elastic resin material such as silicone resin. The connection cap 40 includes a base portion 45, a flange portion (not shown) protruding outward in the radial direction at an end portion of the base portion 45 on the side opposite to the holding unit 22 in the axial direction, and a surrounding convex portion 46.

As shown in FIG. 4, the base portion 45 is formed in a cylindrical shape with the axis O as the central axis. An electrode insertion hole 47 through which the pin electrode 33 is inserted is formed in the base portion 45. The electrode insertion hole 47 penetrates the base portion 45 in the axial direction and communicates with the inside of the housing 31. The pin electrode 33 protrudes from the base portion 45 toward the holding unit 22 side in the axial direction through the electrode insertion hole 47.

The surrounding convex portion 46 protrudes in the axial direction from the end surface of the base portion 45 that faces the holding unit 22 side in the axial direction. The surrounding convex portion 46 is formed in a substantially annular shape extending along the outer peripheral edge of the base portion 45. The surrounding convex portion 46 surrounds the pin electrode 33 at a position separated from the pin electrode 33 to the outside in the radial direction. Further, the surrounding convex portion 46 has a notch portion 46*a* formed in a part of the ring shape of the surrounding convex portion 46. Three notch portions 46*a* are formed evenly at intervals of 120 degree in the circumferential direction. The notch portion 46*a* functions as a circulation path of air. The surrounding convex portion 46 may be located radially inside the outer peripheral edge of the base portion 45 as long as the surrounding convex portion 46 surrounds the pin electrode 33. The surrounding convex portion 46 is not limited to the annular shape, and may have a polygonal shape or the like. The number and position of the notch portions 46*a* may be changed as appropriate. In the present embodiment, meaning of the "surrounding" in the surrounding convex portion is not limited to the one that extends intermittently, but also includes the one that extends continuously. In other words, the surrounding convex portion 46 is not limited to surround the pin electrode 33 intermittently, but also to continuously surround the pin electrode 33. However, in a case in which the surrounding convex portion 46 is formed in a continuous annular shape, it is necessary to separately form an air flow path. The surrounding convex portion 46 in the present embodiment can be appropriately modified as long as it surrounds the pin electrode 33.

The surrounding convex portion 46 is formed in a triangular shape that is sharpened toward the holding unit 22 side in the axial direction in a longitudinal sectional view along the axial direction. The protruding height of the surrounding convex portion 46 from the base portion 45 is lower than that of the pin electrode 33. The protruding height of the surrounding convex portion 46 may be higher than that of the pin electrode 33. The vertical cross-sectional shape of the surrounding convex portion 46 is not limited to the triangular shape.

The first connecting member 41 includes a base cylindrical portion (not shown) arranged in the housing 31, a vertical engaging convex portion (first vertical engaging convex portion 51*a* to third vertical engaging convex portion 51*c*), and a lateral engaging convex portion 52.

An end portion of the base tubular portion on the holding unit 22 side in the axial direction surrounds the periphery of the connection cap 40. An outer flange portion 55 protruding outward in the radial direction is formed at an end portion of the base tubular portion on the side of the holding unit 22 in the axial direction.

As shown in FIGS. 3 and 4, the vertical engaging convex portions 51*a* to 51*c* protrude from the outer flange portion 55 toward the holding unit 22 side (suction side) in the axial direction. A plurality of the vertical engaging convex portions 51*a* to 51*c* are formed at intervals in the circumferential direction. In the present embodiment, each of the vertical engaging convex portions 51*a* to 51*c* is evenly arranged in the circumferential direction at intervals of 120 degree. The vertical engaging convex portion may be single or plural. Further, the pitch of the vertical engaging convex portions 51*a* to 51*c* can be changed appropriately. In this case, the plurality of vertical engaging protrusions 51*a* to 51*c* may be arranged unevenly.

As shown in FIG. 4, in each of the above-described vertical engaging convex portions 51*a* to 51*c*, the vertical engaging convex portions 51*a* to 51*c* are arranged so that the above-described pin electrodes 33 are not arranged on the virtual straight lines La to Lc connecting the axis O and the center of each of the vertical engaging convex portions 51*a* to 51*c* in the circumferential direction. Specifically, the pin electrodes 33 are arranged at a position that is line-symmetric with respect to the virtual straight line La that connects the first vertical engaging convex portion 51*a* and the axis O. That is, the virtual straight line T1 connecting the pin electrodes 33 and the virtual straight line La are orthogonal to each other, and the distances from the virtual straight line La to the pin electrodes 33 are equal to each other.

As shown in FIG. 3, tip ends of the longitudinal engaging convex portions 51*a* to 51*c* located on the holding unit 22 side in the axial direction are located on the holding unit 22 side in the axial direction with respect to the tip ends of the pin electrodes 33. The vertical engaging convex portions 51*a* to 51*c* are formed in a rectangular shape as viewed from the side in the radial direction. At the ends of the longitudinal engaging convex portions 51*a* to 51*c* on the side of the holding unit 22 in the axial direction, the surface facing inward in the radial direction is an inclined surface whose thickness in the radial direction gradually decreases toward the holding unit 22 side in the axial direction. This inclined surface functions as a guide for smoothly guiding the vertical engaging convex portions 51*a* to 51*c* to the engaging recess 180 of the cartridge 11 described later.

As shown in FIGS. 3 and 4, the lateral engaging convex portion 52 protrudes outward in the radial direction from the outer flange portion 55. The lateral engaging convex portion 52 is formed in a rectangular shape in a plan view as seen in the axial direction. A plurality of lateral engaging convex portions 52 are formed at intervals in the circumferential direction. In this embodiment, the four lateral engaging convex portions 52 are evenly arranged at 90 degree intervals in the circumferential direction. In the present embodiment, the one lateral engaging convex portion 52 is arranged at the same position in the circumferential direction as the first vertical engaging convex portion 51*a*. The lateral engaging convex portion 52 may be singular or plural. Further, the pitch of the lateral engaging convex portions 52 may be changed appropriately. In this case, the plurality of lateral engaging convex portions 52 may be arranged unevenly.

The annular piece 42 is formed in a thin annular shape. The above-described base cylinder portion is inserted into the annular piece 42 from the holding unit 22 side in the axial direction. As shown in FIG. 3, a flexure portion 56 is formed in a part of the annular piece 42 in the circumferential direction. The flexure portion 56 is formed in an arch shape that bulges outward in the radial direction. The flexure portion 56 is configured to be elastically deformable in the radial direction. The flexure portion 56 is positioned radially inward of the radially outer end surface of the lateral engaging convex portion 52.

A plurality of the flexure portions 56 described above are formed at intervals in the circumferential direction. For example, the flexure portion 56 is arranged at the same position in the circumferential direction as the pair of lateral engaging convex portions 52 that are opposed to each other in the radial direction (left-right direction) among the lateral engaging convex portions 52. However, the number of the flexure portions 56 may be changed appropriately. For example, the flexure portion 56 may be formed corresponding to each lateral engaging convex portion Ω, or may be formed corresponding to only one lateral engaging convex portion 52.

(Holding Unit)

Figure 5:
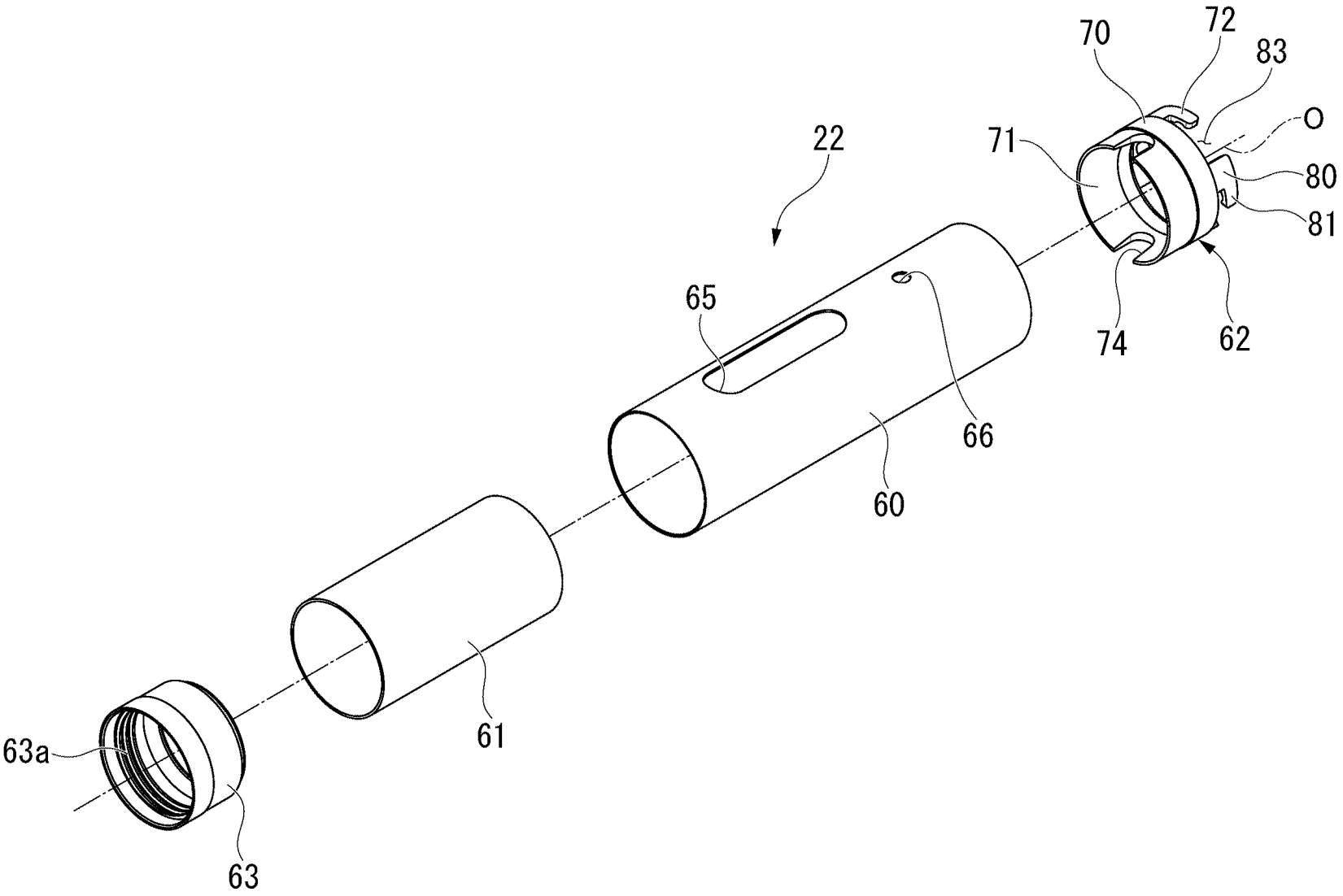
FIG. 5 is an exploded perspective view of the holding unit according to the embodiment.

FIG. 5 is an exploded perspective view of the holding unit 22.

As shown in FIG. 5, the holding unit 22 is detachably attached to the power supply unit 21 and the mouthpiece 23. Specifically, the holding unit 22 includes a container holding cylinder 60, a transparent cylinder 61, a second connecting member 62, and a sleeve 63.

The container holding cylinder 60 is formed in a cylindrical shape with the axis O as the central axis. An observation hole 65 is formed in the central portion of the container holding cylinder 60 in the axial direction. The observation hole 65 penetrates the container holding cylinder 60 in the radial direction. The observation hole 65 is formed in an oval shape having the axial direction as the longitudinal direction. The observation holes 65 are formed in a pair in the portions of the container holding cylinder 60 that face each other in the radial direction. The number, position, shape, and the like of the observation holes 65 can be changed as appropriate.

A ventilation port 66 is formed in a portion of the container holding cylinder 60, and is located closer to the power supply unit 21 side (anti-suction port side) than the observation hole 65. The ventilation port 66 penetrates the container holding cylinder 60 in the radial direction. The ventilation port 66 communicates the inside and outside of the holding unit 22. The ventilation ports 66 are formed in a pair in portions of the container holding cylinder 60 so as to face each other in the radial direction (the front and back directions). The number, position, shape, and the like of the ventilation ports 66 can be changed as appropriate.

The transparent cylinder 61 is formed of a material having light transparency. The transparent cylinder 61 is inserted into the container holding cylinder 60. Specifically, in the container holding cylinder 60, the transparent cylinder 61 is arranged on the mouthpiece 23 side (suction side) in the axial direction with respect to the ventilation port 66, and covers the observation hole 65 from the inside in the radial direction. That is, the user can visually recognize the inside of the holding unit 22 through the observation hole 65 and the transparent cylinder 61. The holding unit 22 may have a configuration that does not have the observation hole 65 and the transparent cylinder 61.

The second connecting member 62 is locked to the above-described first connecting member 41 when the holding unit 22 is connected to the power supply unit 21. The second connecting member 62 includes a fitting cylinder 70, a guide cylinder 71, and a locking piece 72.

The fitting cylinder 70 is formed in a cylindrical shape with the axis O as the central axis. The fitting cylinder 70 is fitted into a portion, where is located closer to the power supply unit 21 in the axial direction than the transparent cylinder 61, of the container holding cylinder 60.

The guide cylinder 71 is arranged coaxially with the fitting cylinder 70. The guide cylinder 71 extends from the fitting cylinder 70 toward the mouthpiece 23 side in the axial direction. The guide cylinder 71 is formed in a tapered cylinder shape whose inner diameter gradually increases toward the mouthpiece 23 side in the axial direction. The outer diameter of the guide cylinder 71 is smaller than the outer diameter of the fitting cylinder 70. An escape portion 74 is formed in the guide cylinder 71 at a position where it overlaps with the above-described ventilation port 66 when viewed from the side in the radial direction. The escape portion 74 is formed, for example, in a U-shape that opens toward the mouthpiece 23 side in the axial direction. The ventilation port 66 opens into the holding unit 22 through the escape portion 74. The escape portion 74 may have any shape as long as at least a part of the ventilation port 66 is exposed in the holding unit 22. In a case in which the guide cylinder 71 and the ventilation port 66 are arranged at different positions in the axial direction, the guide cylinder 71 may not have the escape portion 74.

Figure 6:
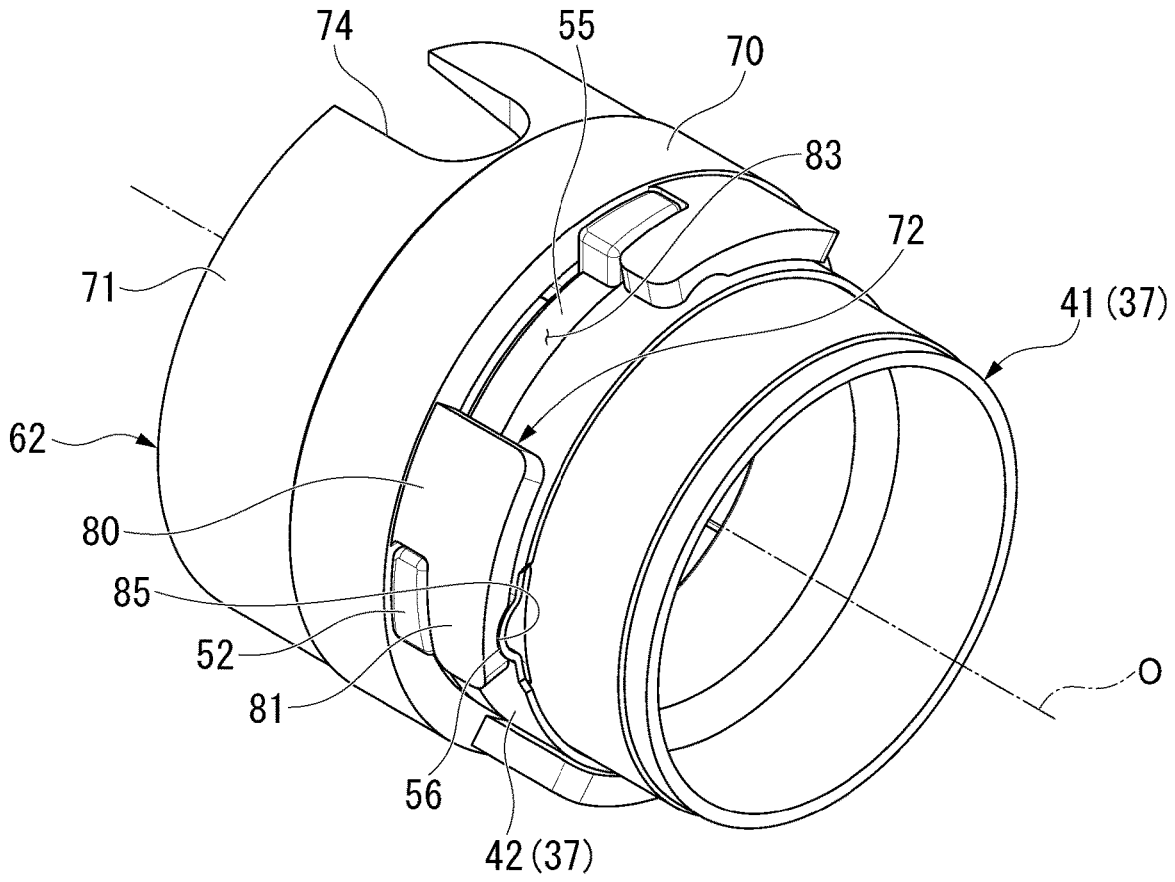
FIG. 6 is a perspective view showing a connection structure of a first connecting member and a second connecting member according to the embodiment.

FIG. 6 is a perspective view showing a connection structure of the first connecting member 41 and the second connecting member 62.

As shown in FIGS. 5 and 6, the locking piece 72 protrudes from the fitting cylinder 70 toward the power supply unit 21 in the axial direction. The locking piece 72 is formed in an L shape in a side view as seen from the radial direction. The locking piece 72 has a vertically extending portion 80 and a horizontally extending portion 81. The vertically extending portion 80 protrudes from the fitting cylinder 70 toward the power supply unit 21 side in the axial direction. The horizontally extending portion 81 extends in a cantilever manner from an end part of the vertically extending portion 80 on the power supply unit 21 side in the axial direction toward one side in the circumferential direction.

Figure 7:
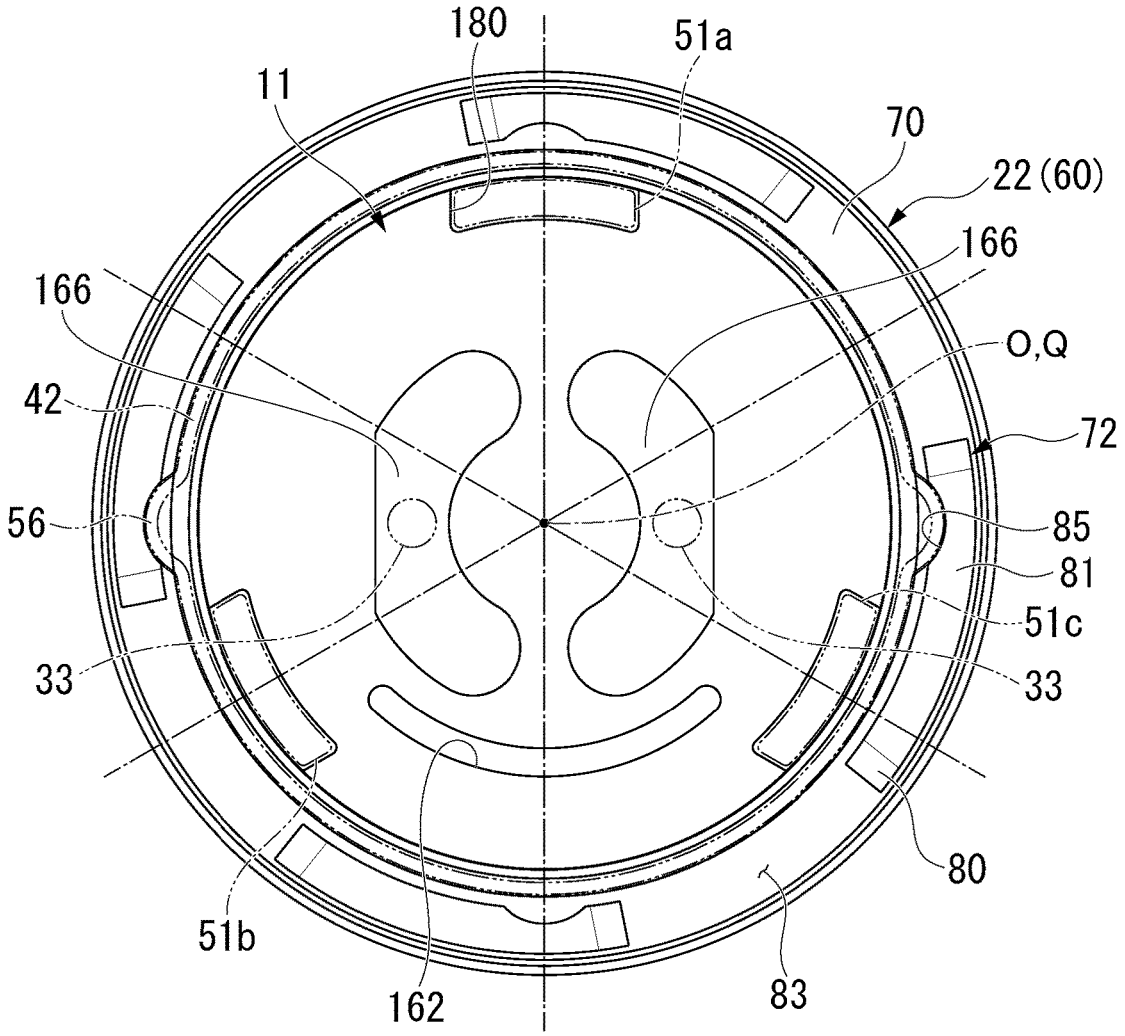
FIG. 7 is a plan view of the holding unit and the cartridge according to the embodiment as seen from the power supply unit side in the axial direction.

FIG. 7 is a plan view of the holding unit 22 and the cartridge 11 as viewed from the power supply unit 21 side in the axial direction.

As shown in FIG. 6 and FIG. 7, an engaging recess 85 that is recessed outward in the radial direction is formed at one end portion in the circumferential direction in the horizontally extending portion 81. The engaging recess 85 is formed in a semicircular shape outward in the radial direction.

A plurality of the locking pieces 72 described above are formed at intervals in the circumferential direction. In this embodiment, the locking pieces 72 are evenly arranged at 90 degree intervals in the circumferential direction. An engaging groove 83 into which the above-described lateral engaging convex portion 52 is inserted is defined between the locking pieces 72 adjacent to each other in the circumferential direction. The engaging groove 83 is formed in an L shape in a side view.

As shown in FIG. 6, the power supply unit 21 and the holding unit 22 are detachable by connecting the locking piece 72 and the lateral engaging convex portion 52. That is, in order to connect the power supply unit 21 and the holding unit 22, after inserting the lateral engaging convex portion 52 in the engaging groove 83 in the axial direction, the power supply unit 21 and the holding unit 22 are relatively rotated around the axis O. Then, the lateral engaging convex portion 52 axially engages between the horizontally extending portion 81 and the fitting cylinder 70. In the process in which the power supply unit 21 and the holding unit 22 relatively rotate about the axis O, the flexure portion 56 of the annular piece 42 fits into the engaging recess 85. As a result, the flexure portion 56 engages with the engaging recess 85 in the circumferential direction. As a result, the power supply unit 21 and the holding unit 22 are assembled to each other in a state in which they are positioned in the axial direction and the circumferential direction.

The engaging groove 83 of the present embodiment is formed in a taper shape between the fitting cylinder 70 and the horizontally extending portion 81 such that the width in the axial direction becomes gradually narrower from the other side to the one side in the circumferential direction. Specifically, an end surface of the horizontally extending portion 81 facing the mouthpiece 23 side in the axial direction is an inclined surface gradually extending toward the power supply unit 21 side in the axial direction from the other side toward the one side in the circumferential direction.

The lateral engaging convex portion 52 is formed in a taper shape in which the width in the axial direction gradually decreases from one side toward the other side in the circumferential direction. Specifically, an end surface of the above-described lateral engaging convex portion 52 facing the side opposite to the axial holding unit 22 is inclined so as to gradually extend toward the mouthpiece 23 side in the axial direction from one side to the other side in the circumferential direction. Thereby, when the power supply unit 21 and the holding unit 22 are connected, interference between the horizontally extending portion 81 and the lateral engaging convex portion 52 is capable of being suppressed, and the assembling property is capable of being improved.

As shown in FIG. 5, the sleeve 63 is press-fitted into a portion, where is located closer to the mouthpiece 23 side in the axial direction than the transparent cylinder 61, of the container holding cylinder 60 by press fitting or the like. The transparent cylinder 61 described above is axially held between the second connecting member 62 and the sleeve 63. A female screw portion 63*a* is formed on the inner peripheral surface of the sleeve 63.

(Mouthpiece)

Figure 8:
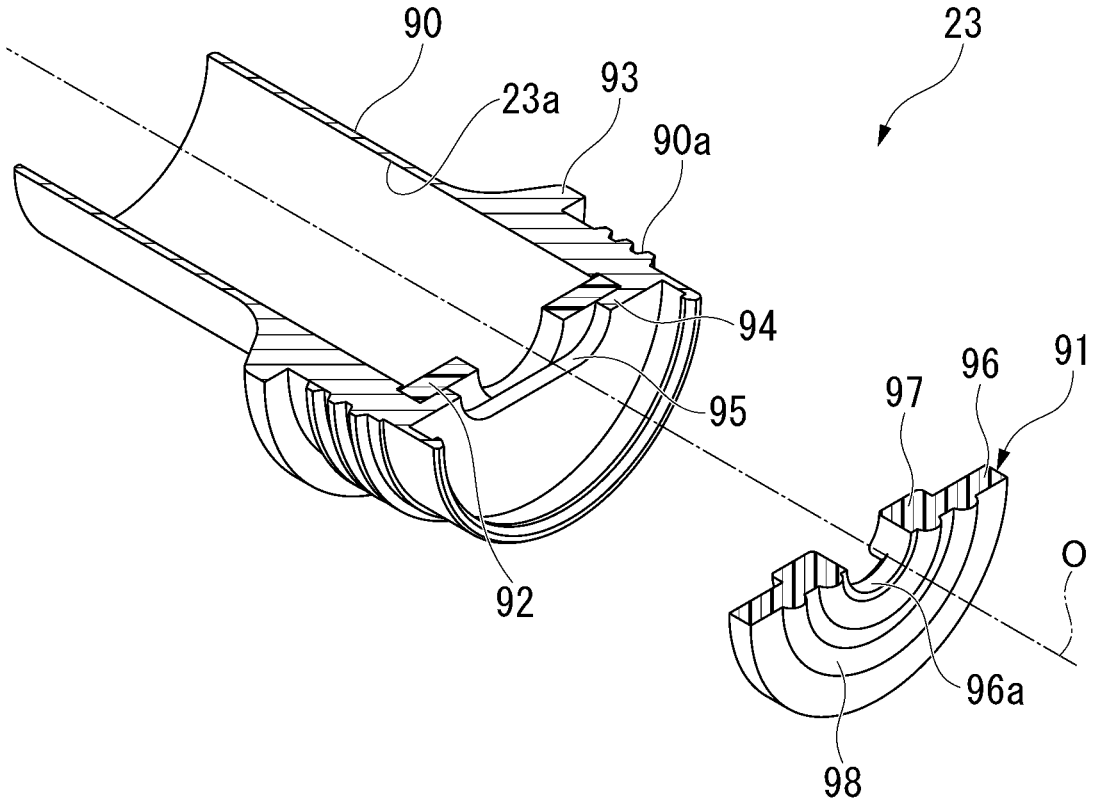
FIG. 8 is an exploded perspective view of the mouthpiece corresponding to the line VIII-VIII in FIG. 1.

FIG. 8 is an exploded perspective view of the mouthpiece 23 corresponding to the line VIII-VIII in FIG. 1.

As shown in FIG. 8, the mouthpiece 23 includes a mouthpiece body 90 and an anti-slip member (a first anti-slip member 91 and a second anti-slip member 92).

The mouthpiece 23 is formed with a suction port 23*a* capable of accommodating the tobacco capsule 12. The mouthpiece body 90 is formed in a multi-stage tubular shape with the axis O as the central axis. A male screw portion 90*a* is formed at an end of the mouthpiece body 90 on the side of the holding unit 22 in the axial direction. The male screw portion 90*a* of the mouthpiece body 90 is screwed to be detachably attached to the female screw portion 63*a* of the sleeve 63 described above. The mouthpiece body 90 may be configured to be attached to and detached from the sleeve 63 by a method other than screwing, for example, fitting or the like.

An abutting flange 93 is formed on a portion, where is axially opposite to the holding unit 22 with respect to the male screw portion 90*a*, of the mouthpiece body 90. The abutting flange 93 is formed in an annular shape protruding outward in the radial direction. The abutting flange 93 abuts the holding unit 22 in the axial direction when the mouthpiece 23 is attached to the holding unit 22. An outer diameter of the abutting flange 93 is gradually reduced as it is separated from the holding unit 22 in the axial direction.

A partition portion 94 that partitions the inside of the mouthpiece body 90 in the axial direction is formed at the end of the mouthpiece body 90 on the side of the holding unit 22 in the axial direction. A through hole 95 penetrating the partition portion 94 in the axial direction is formed in the partition portion 94 at a position overlapping the axis O. The through hole 95 has, for example, an oval shape with one longitudinal direction in the radial direction. The plan view shape of the through hole 95 may be a perfect circle, a polygon, or the like.

The first anti-slip member 91 is integrally formed of a resin material such as silicone resin. The first anti-slip member 91 includes a ring portion 96, a fitting protrusion 97, and a contact protrusion 98.

The ring portion 96 is fitted in the mouthpiece body 90 from the holding unit 22 side in the axial direction. The first anti-slip member 91 is axially positioned with respect to the mouthpiece body 90 by the ring portion 96 abutting the partition portion 94 in the axial direction. A communication hole 96*a* is formed in the center of the ring portion 96. The communication hole 96*a* connects the inside of the holding unit 22 and the inside of the mouthpiece body 90 through the through hole 95 described above.

The fitting protrusions 97 are formed in a pair on the inner peripheral edge of the ring portion 96 at positions radially opposite to each other with the communication hole 96*a* interposed therebetween. The fitting protrusions 97 protrude from the ring portion 96 in the axial direction to the side opposite to the holding unit 22. The fitting protrusions 97 are fitted to both ends of the through hole 95 in the radial direction. Thereby, the first anti-slip member 91 is positioned in the circumferential direction with respect to the mouthpiece body 90. In the present embodiment, the configuration in which the fitting protrusion 97 is fitted in the through hole 95 is described, but the fitting protrusion 97 may be fitted into a hole different from the through hole 95.

The contact protrusion 98 protrudes from the ring portion 96 toward the holding unit 22 side in the axial direction. The contact protrusion 98 is formed in a circular shape centered on the axis O. In the present embodiment, the contact projections 98 are formed in two concentric circles. The first anti-slip member 91 may not have the contact protrusion 98.

The second anti-slip member 92 is an integrally formed of a resin material such as silicone resin. The second anti-slip member 92 is fitted in the mouthpiece body 90 from the side opposite to the axial holding unit 22. The second anti-slip member 92 is axially positioned with respect to the mouthpiece body 90 by being abutted against the partition portion 94 in the axial direction.

(Tobacco Capsule)

As shown in FIG. 2, the tobacco capsule 12 is detachably mounted in the mouthpiece body 90 from the side opposite to the holding unit 22 in the axial direction. The tobacco capsule 12 includes a capsule portion 77 and a filter portion 78. The tobacco capsule 12 is configured as a flavor source container.

The capsule portion 77 is formed in a bottomed cylindrical shape with the axis O as the central axis such that a bottom wall portion (not shown) closing an inner opening space of the capsule portion 77 on the holding unit 22 side in the axial direction. A mesh opening that penetrates the bottom wall portion in the axial direction is formed in the bottom wall portion of the capsule portion 77.

The filter portion 78 is fitted in the capsule portion 77 from the side opposite to the holding unit 22 in the axial direction. For example, tobacco leaves are enclosed in the space defined by the capsule portion 77 and the filter portion 78. A flavor source other than tobacco leaf may be enclosed.

(Cartridge)

As shown in FIGS. 1 and 2, the cartridge 11 stores a liquid aerosol source and atomizes the liquid aerosol source. The cartridge 11 is housed in the transparent cylinder 61 of the holding unit 22.

Figure 9:
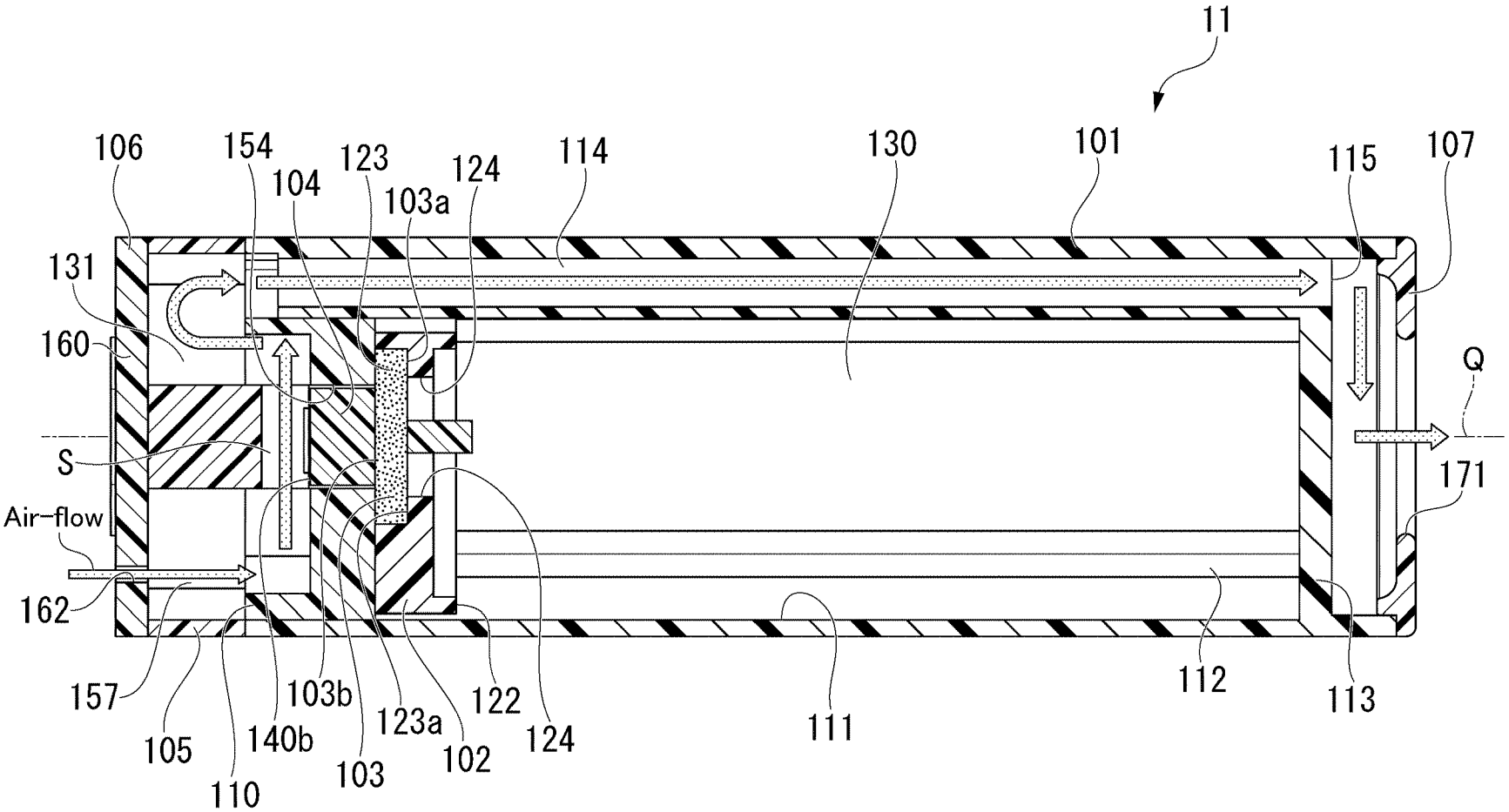
FIG. 9 is a sectional view taken along the axial direction of the cartridge according to the embodiment.
Figure 10:
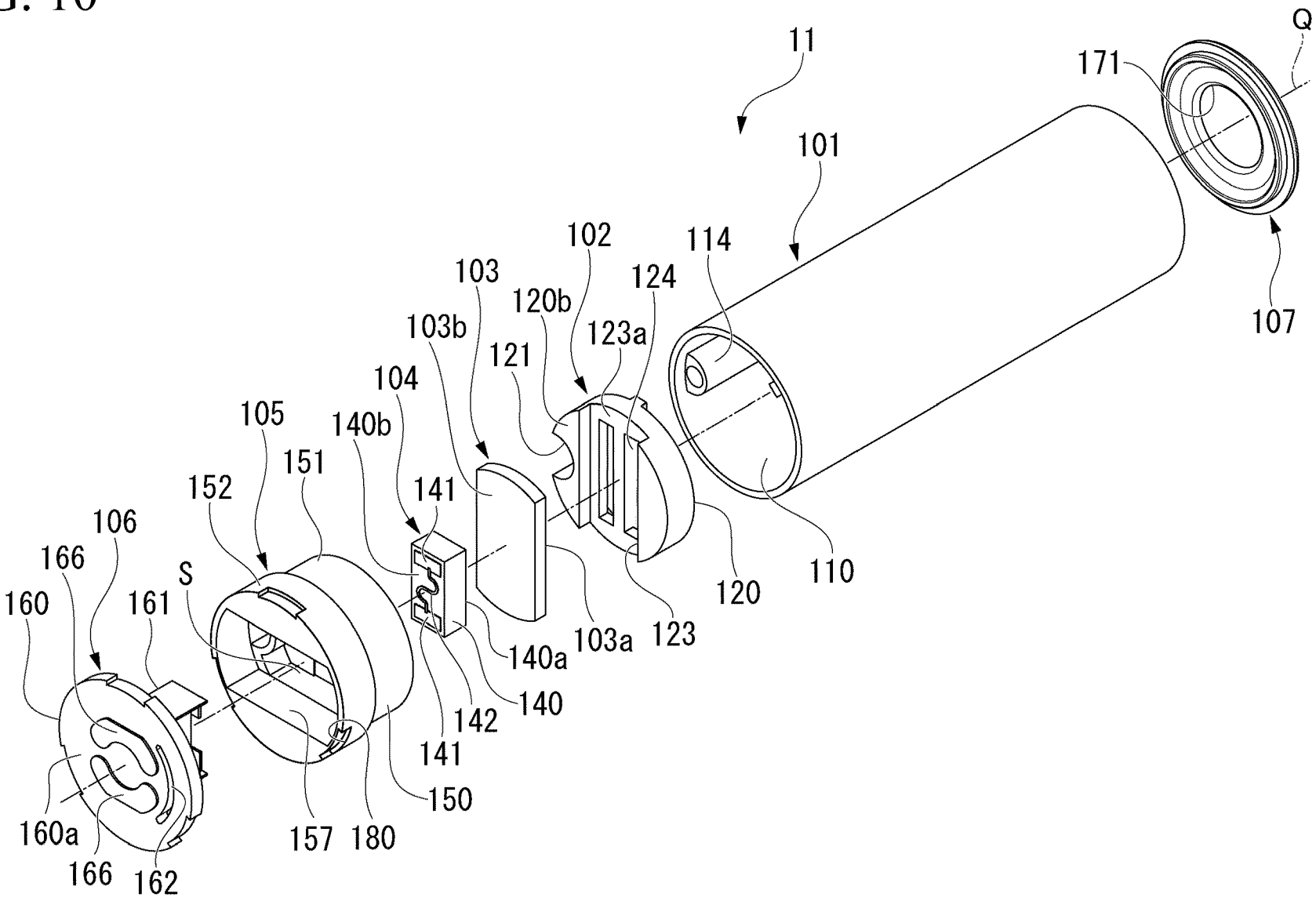
FIG. 10 is an exploded perspective view of the cartridge according to the embodiment.

FIG. 9 is a sectional view taken along the axial direction (axis line Q) of the cartridge 11. FIG. 10 is an exploded perspective view of the cartridge 11.

As shown in FIGS. 9 and 10, the cartridge 11 includes a bottomed cylindrical tank 101, a substantially columnar shape gasket 102 housed in the tank 101, a substantially plate-shaped mesh body 103, a heater 104, an atomization container 105, a heater holder 106 that closes an opening 110 of the tank 101, and an end cap 107 that is attached to the tank 101 on an opposite side to the heater holder 106 in the axial direction.

Figure 11:
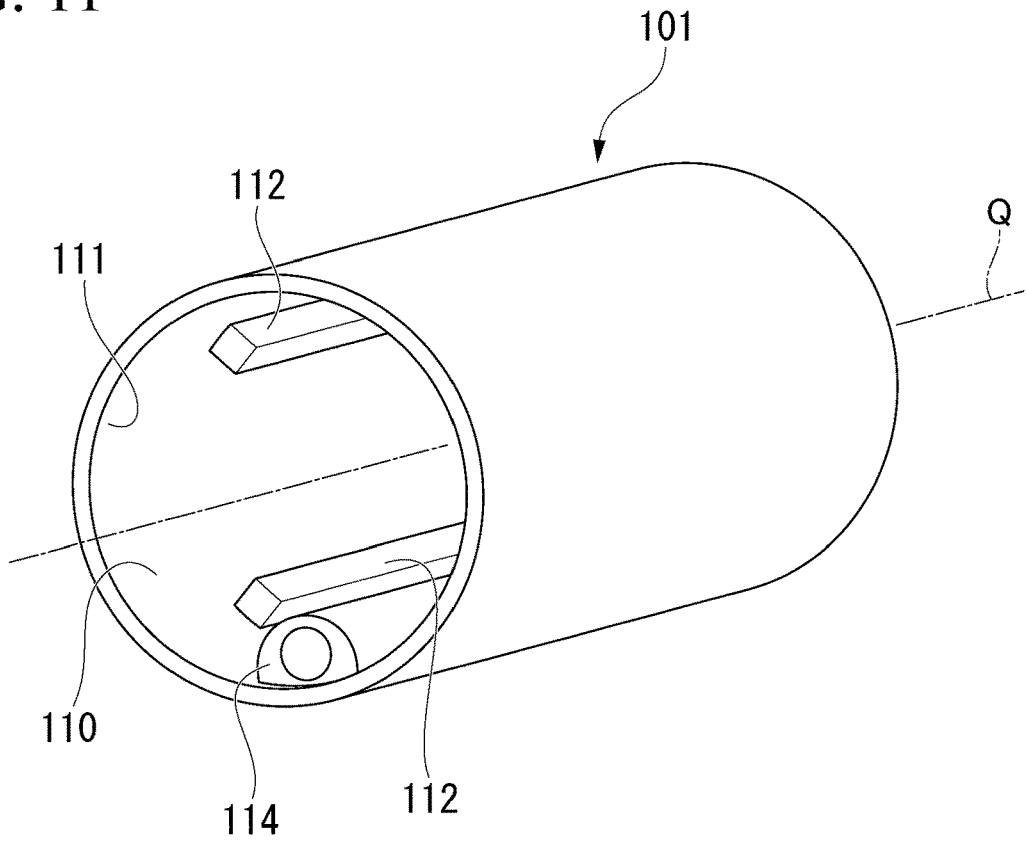
FIG. 11 is a perspective view of the tank according to the embodiment as seen from the opening side.

FIG. 11 is a perspective view of the tank 101 viewed from the opening 110 side.

As shown in FIGS. 9 to 11, ribs 112 are formed on the inner peripheral wall 111 of the tank 101. Four ribs 112 are formed at substantially equal intervals in the circumferential direction. The ribs 112 are formed along the axis line Q direction of the inner peripheral wall 111 of the tank 101. The rib 112 is provided between a bottom plate 113 provided near the end of the tank 101 on the mouthpiece 23 side and a part slightly before the end (tip end) on the opening 110 side. The ribs 112 are formed in a rectangular shape when viewed from the axis line Q direction. The shape and the number of ribs 112 may be changed as appropriate. The tank 101 is made of a light-transmissive material, and the remaining amount of the aerosol source contained therein can be visually confirmed.

An aerosol passage pipe 114 is formed on the inner peripheral wall 111 of the tank 101 along the axis line Q direction. The aerosol channel pipe 114 is formed from an end of the opening 110 to the bottom plate 113. The bottom plate 113 of the tank 101 is formed with a through hole 115 penetrating the bottom plate 113. The inside of the aerosol flow path pipe 114 and the through hole 115 are in communication with each other. The aerosol flow path pipe 114 and the through hole 115 become a flow path (arrow in FIG. 9) of atomized aerosol.

The axis line Q coincides with the axis O of the main body unit 10 when the cartridge 11 is housed in the transparent cylinder 61. The axis line Q is an axis line that is common to each part that constitutes the cartridge 11. In the following, the axis line Q is not limited to the axis line Q of the tank 101, but is used in the description of each part constituting the cartridge 11.

Figure 12:
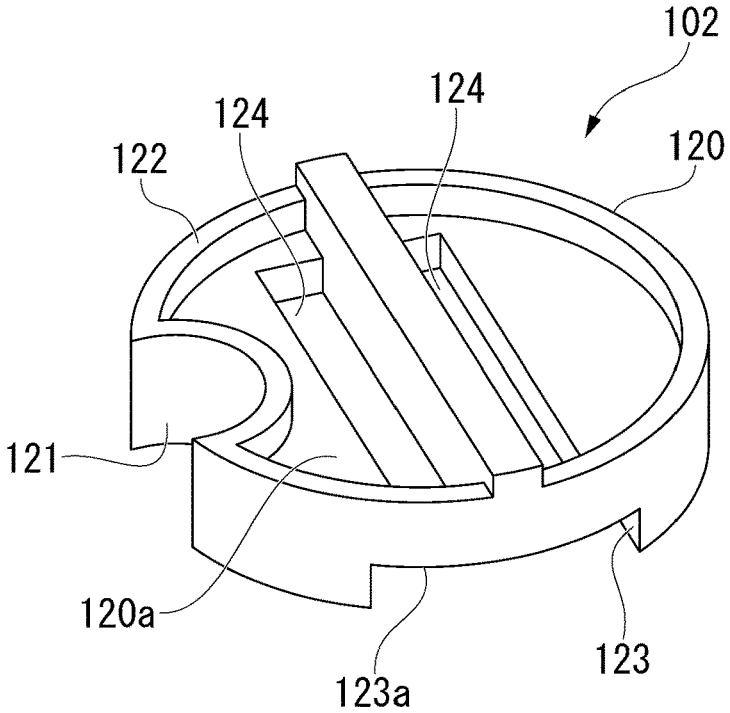
FIG. 12 is a perspective view of a gasket according to the embodiment.

FIG. 12 is a perspective view of the gasket 102.

As shown in FIG. 12, the gasket 102 is formed in a substantially columnar shape having an outer diameter substantially equal to the inner diameter of the tank 101. The gasket 102 is housed in the tank 101. A concave groove 121 into which the aerosol channel pipe 114 is capable of being inserted is formed on the peripheral edge of the main body 120 of the gasket 102. The concave groove 121 is formed over the entire length in the axis line Q direction, and is formed in a substantially arc shape along the outer shape of the aerosol flow channel tube 114. A flange portion 122 is formed on the outer peripheral edge of one surface 120*a* of the body portion 120 on the mouthpiece 23 side such that the flange portion 122 rises from the one surface 120*a* to the mouthpiece 23 side. When the gasket 102 is stored in the tank 101, the concave groove 121 may be aligned with the position of the aerosol flow path pipe 114 and inserted in the axis line Q direction. The gasket 102 is inserted to a position where the flange portion 122 of the gasket 102 abuts on the rib 112 of the tank 101. The gasket 102 is held at the position where it abuts against the rib 112. With the gasket 102 positioned, the outer peripheral surface of the gasket 102 is in contact with the inner peripheral wall 111 of the tank 101. The recessed groove 121 of the gasket 102 is in contact with the outer peripheral surface of the aerosol flow channel tube 114.

The mesh body 103 is held on the other surface 120*b* of the main body 120 on the power supply unit 21 side. A concave portion 123 capable of accommodating the mesh body 103 is formed substantially in the center of the other surface 120*b*. By accommodating the mesh body 103 in the recess 123, the mesh body 103 is positioned and the posture of the mesh body 103 is maintained. That is, the mesh body 103 is fitted in the recess 123. A through hole 124, through which an aerosol source can flow, is formed in the bottom surface 123*a* of the recess 123 and in the radial center of the gasket 102. Two through holes 124 are formed in parallel in a rectangular shape when viewed from the axis line Q direction.

As shown in FIG. 10, the mesh body 103 is a porous member having a liquid absorbing property. The mesh body 103 is formed of, for example, a cotton fiber material. The mesh body 103 is formed in substantially the same shape as the recess 123 of the gasket 102.

The inside of the tank 101 is partitioned into a liquid storage chamber 130 defined on the mouthpiece 23 side of the mesh body 103 and an opening chamber 131 on the power supply unit 21 side of the mesh body 103. A liquid aerosol source is stored in the liquid storage chamber 130. The opening chamber 131 is a chamber for atomizing the aerosol source sucked up by the mesh body 103.

A first surface 103*a* of the mesh body 103 on the mouthpiece 23 side is in contact with the bottom surface 123*a* of the gasket 102. A second surface 103*b* of the mesh body 103 on the power supply unit 21 side is exposed to the opening chamber 131. The heater 104 is provided so as to be connected to the second surface 103*b* of the mesh body 103 exposed in the opening chamber 131.

Figure 13:
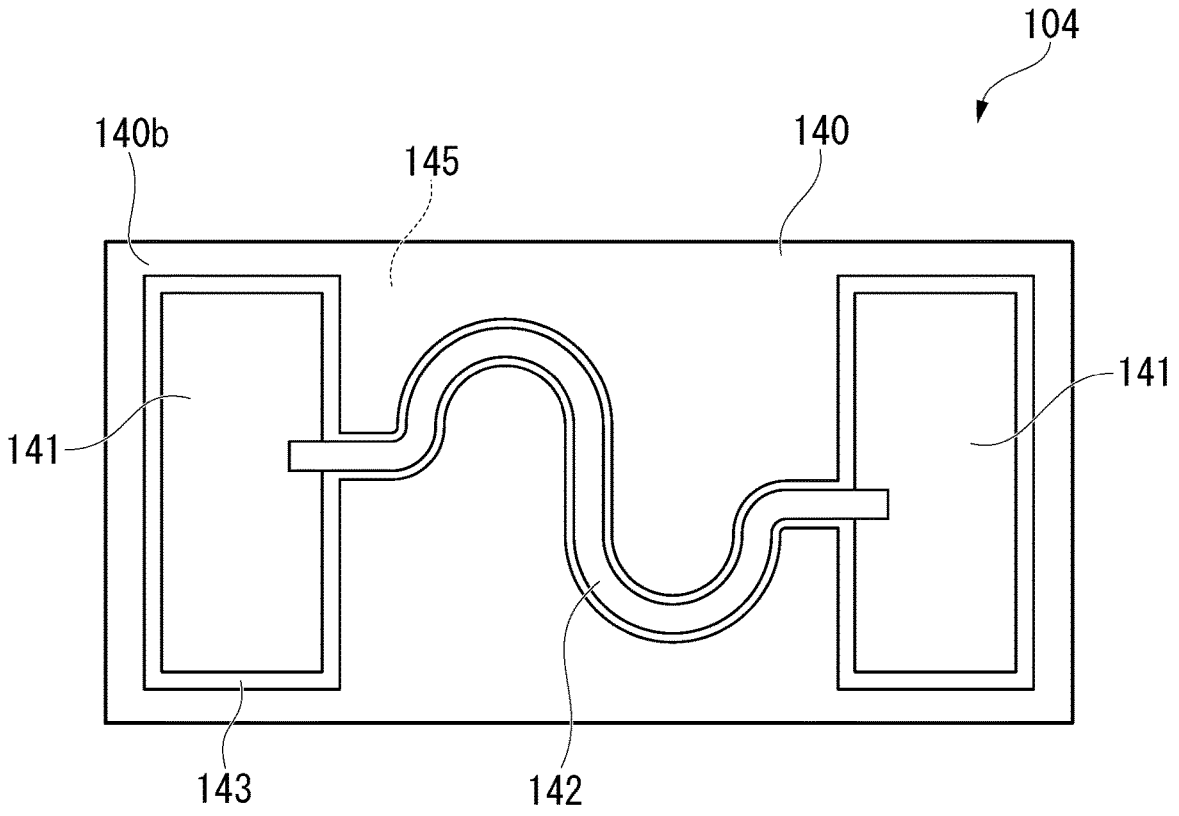
FIG. 13 is a plan view of the heater according to the embodiment.

FIG. 13 is a plan view of the heater 104 viewed from the power supply unit 21 side.

As shown in FIGS. 10 and 13, the heater 104 is for atomizing a liquid aerosol source. The heater 104 is housed in the opening chamber 131. The heater 104 includes a substantially rectangular parallelepiped porous ceramic substrate 140. The porous ceramic substrate 140 is configured as a main body of the heater 104. The shape and thickness of the porous ceramic substrate 140 may be changed appropriately.

One surface 140*a* of the porous ceramic substrate 140 on the mouthpiece 23 side is in contact with the second surface 103*b* of the mesh body 103. As a result, the aerosol source absorbed by the mesh body 103 is sucked up into the porous ceramic substrate 140.

A pair of electrode patterns 141 is provided on the heat generating surface 140*b*, which is the other surface of the porous ceramic substrate 140 on the power supply unit 21 side. The pair of electrode patterns 141 have a strip shape along substantially both sides in the radial direction of the heat generating surface 140*b* having a long shape. The heat generating surface 140*b* is provided with a resistor pattern 142 that connects the pair of electrode patterns 141. The resistor pattern 142 has a meandering curved shape when viewed from the direction of the axis line Q. Both ends of the resistor pattern 142 are connected to the pair of electrode patterns 141, respectively, and are configured to be electrically conductive. In the resistor pattern 142, one ends of a pair of U-shaped arcs are connected to each other, and the other ends are connected to the pair of electrode patterns 141, respectively. The resistor pattern 142 is configured to be able to raise its temperature to a predetermined temperature when electricity flows through the electrode pattern 141. A temperature of the resistor pattern 142 rises to an appropriate temperature at which aerosol is generated. The shape of the resistor pattern 142 is arbitrary and may not be a meandering curved shape. The pair of electrode patterns 141 and the resistor pattern 142 are arranged on the glass layer 143 formed on the heat generating surface 140*b*.

A liquid supply channel 145 is formed on the porous ceramic substrate 140. The liquid supply channel 145 is a flow path through which a liquid (aerosol source) flows. In the liquid supply channel 145, the liquid is configured to be capable of proceeding in the liquid supply channel 145 by, for example, a capillary phenomenon. The liquid supply channel 145 causes the aerosol source to flow from one surface 140*a* toward the heat generating surface 140*b*.

The manufacturing method of the heater 104 will be described in detail below.

Figure 14:
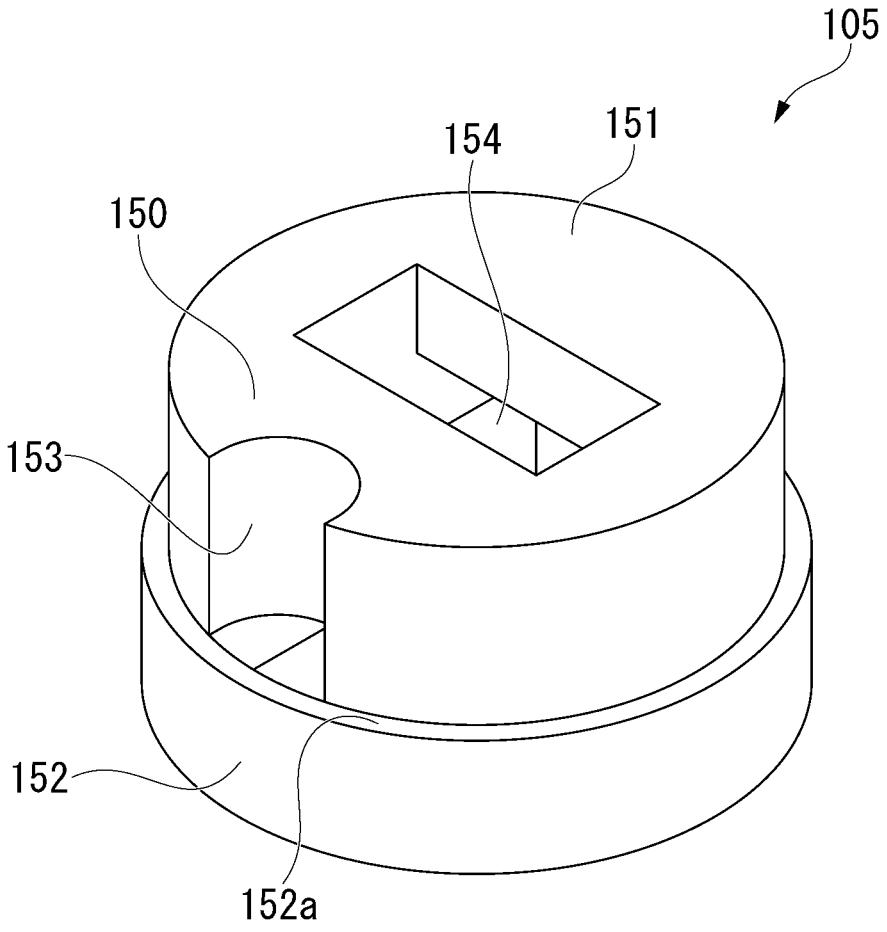
FIG. 14 is a perspective view of a heater holder according to the embodiment.

FIG. 14 is a perspective view of the atomization container 105.

As shown in FIGS. 10 and 14, the atomization container 105 is formed in a multistage cylindrical shape with the axis line Q as the central axis. The main body part 150 of the atomizing container 105 has a first cylinder portion 151 on the mouthpiece 23 side, the outer diameter of which is substantially the same as the inner diameter of the tank 101, and a second cylinder portion 152 on the power supply unit 21 side, the outer diameter of which is substantially the same as the outer diameter of the tank 101. The atomization container 105 is arranged so as to close the opening 110 of the tank 101.

The first tubular portion 151 is housed in the tank 101. A concave groove 153 into which the aerosol flow path tube 114 can be inserted is formed on the peripheral edge of the first tubular portion 151. The recessed groove 153 is formed over the entire length of the first tubular portion 151 in the axis line Q direction, and is formed in a substantially arc shape along the outer shape of the aerosol flow channel pipe 114.

A through hole 154, through which the heater 104 can be inserted, is formed in the center of the first tubular portion 151 in the radial direction. The through hole 154 is formed to have substantially the same shape as the outer shape of the heater 104. When the heater 104 is arranged in the through hole 154, the heating surface 140*b* of the heater 104 is configured to be exposed to the power supply unit 21 side (opening chamber 131).

The second tubular portion 152 is continuously provided on the power supply unit 21 side of the tank 101. The step surface 152*a* between the first cylinder portion 151 and the second cylinder portion 152 abuts on the end surface of the tank 101 on the power supply unit 21 side, whereby the tank 101 and the atomization container 105 are positioned.

A through hole 157 is formed in the center of the second tubular portion 152 in the radial direction so as to penetrate in the axis line Q direction. The through hole 157 communicates with the through hole 154 of the first tubular portion 151. The through hole 157 communicates with the groove 153. The through hole 157 communicates with the aerosol flow path pipe 114. The through hole 157 of the second tubular portion 152 is formed in a size that allows the power supply bypass portion 161 provided in the heater holder 106 to be inserted therethrough.

The space S defined by the through hole 154 of the first tubular portion 151 and the through hole 157 of the second tubular portion 152 is configured as an aerosol generating portion. The aerosol generated in the space S passes through the aerosol flow path tube 114 and is guided to the mouthpiece 23 side (arrow in FIG. 9).

Figure 15:
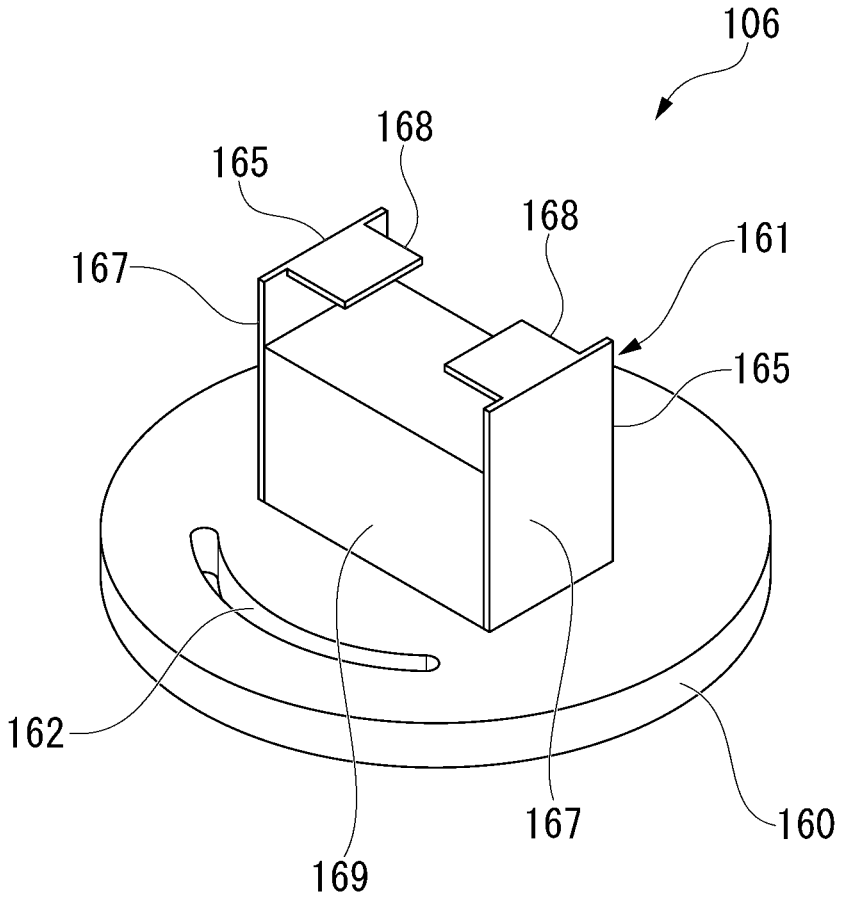
FIG. 15 is a perspective view of a cap according to the embodiment.

FIG. 15 is a perspective view of the heater holder 106.

As shown in FIGS. 10 and 15, the heater holder 106 includes a disc-shaped main body portion 160 having the axis line Q as the central axis, and a power supply bypass portion 161 provided in the main body portion 160.

The main body portion 160 is formed in a disc shape, and is configured to be capable of contacting the end surface of the second tubular portion 152 of the atomization container 105 on the power supply unit 21 side. The main body portion 160 is formed with a through hole 162 penetrating in the axis line Q direction. The through hole 162 communicates with the through hole 157 of the atomization container 105. Air is taken into the cartridge 11 through the through hole 162. More specifically, when the user inhales from the mouthpiece 23, the inside of the suction device 1 has a negative pressure. Then, air is taken into the suction device 1 from the ventilation port 66 of the holding unit 22. The air taken in from the ventilation port 66 is guided from the outside of the surrounding convex portion 46 to the inside of the surrounding convex portion 46 through the notch portion 46*a*. After that, the air flows into the cartridge 11 through the through hole 162 of the main body 160, and flows in the aerosol flow pipe 114 together with the aerosol generated near the heater 104.

The power supply bypass portion 161 has a pair of electrode plates 165 and 165. The electrode plate 165 is formed by bending a metal plate material. The electrode plate 165 includes a pin electrode connecting portion 166 exposed on a surface 160*a* of the main body portion 160 on the power supply unit 21 side, an extending portion 167 provided continuously with the pin electrode connecting portion 166 and extending in the axis line Q direction, and a heater connecting portion 168 folded back at the end of the portion 167 on the mouthpiece 23 side and extending in the radial direction. A spacer 169 is arranged between the pair of electrode plates 165.

When the cartridge 11 is attached to the main body unit 10, the pin electrode connecting portion 166 contacts the pin electrode 33 of the power supply unit 21 and is electrically connected. Further, when the heater holder 106 is attached to the tank 101, the heater connecting portion 168 contacts the electrode pattern 141 of the heater 104 and is electrically connected.

As shown in FIGS. 2 and 10, three engaging recesses 180 facing the power supply unit 21 are formed on peripheral walls of the atomization container 105 and the heater holder 106. The three engaging recesses 180 are arranged at equal intervals in the circumferential direction (120 degree intervals in the circumferential direction). The engaging recesses 180 are formed so that the outside in the radial direction and the end on the power supply unit 21 side are opened. At the end of the engaging recess 180 on the power supply unit 21 side, a tapered flat chamfer is formed in which the circumferential width of the engaging recess 180 gradually increases toward the end. The vertical engaging convex portions 51*a* to 51*c* of the first connecting member 41 are inserted into the three engaging recesses 180 formed in this way. Thereby, the cartridge 11 and the first connecting member 41 are connected, and the cartridge 11 and the first connecting member 41 are positioned in the circumferential direction.

The end cap 107 is a substantially annular plate-shaped member attached to the end of the tank 101 on the suction port side. A through hole 171 is formed at the center of the end cap 107 in the radial direction.

The flow of air in the cartridge 11 (flow of aerosol) will be described with reference to FIG. 9. When air is taken in from the through hole 162 of the heater holder 106, the air is guided into the opening chamber 131 (space S). The aerosol source (liquid) guided near the heat generating surface 140*b* of the heater 104 changes into an aerosol (gas) as the resistor pattern 142 heats up. The aerosol generated in the vicinity of the heat generating surface 140*b* is introduced into the aerosol flow path pipe 114 of the tank 101 from the through hole 157 of the atomizing container 105 together with the air taken in the opening chamber 131 (space S). The aerosol passes from the aerosol flow path tube 114 through the through hole 115 of the bottom plate 113, and flows from the through hole 171 of the end cap 107 to the mouthpiece 23. The user can suck the aerosol together with the air from the suction port 23*a* of the mouthpiece 23.

Here, the configuration of the heater 104 will be described in detail. Note that, in the following embodiments, the drawings are appropriately simplified or modified, and the dimensional ratios and shapes of the respective parts are not necessarily drawn accurately.

(Example)

FIG. 13 is a plan view showing the heater (porous ceramic heating element) 104. The heater 104 includes a porous ceramic substrate 140 formed in a rectangular parallelepiped shape having, for example, a long side of 6.0 mm, a short side of 3.0 mm, and a thickness of 3.0 mm, a glass layer 143 fixed by sintering to a heat generating surface 140*b* that is one surface of the porous ceramic substrate 140 and functions as a heating surface, and a resistor pattern 142 and an electrode pattern 141, which are respectively fixed on the glass layer 143 by sintering. The heat generating surface 140*b* of the porous ceramic substrate 140 has a rectangular shape and functions as an atomizing surface of a predetermined liquid that has infiltrated into the heater 104 by a capillary phenomenon.

The porous ceramic substrate 140 is a porous inorganic sintered body containing alumina, zirconia, mullite, silica, titania, silicon nitride, silicon carbide, or carbon, as a main component, and has, for example, continuous ventilation holes having an average pore size of 0.15 μm to 500 μm, preferably 1.5 μm to 72 μm. The porous inorganic sintered body has a ratio of porosity to tortuosity (ratio of porosity to tortuosity coefficient) of, for example, 21 or more, preferably 26 or more, and an average porosity of, for example, 30% by volume to 90% by volume, preferably 40% by volume to 71% by volume.

The glass layer 143 is made of a glass containing Ba, B, Zn, Si, for example, borosilicate glass, and the glass layer 143 has a softening point lower than the firing temperature of the porous ceramic substrate 140 and equal to or higher than the firing temperatures of the resistor pattern 142 and the electrode pattern 141. The glass layer 143 is a dense glass film fixed to the heating surface 140*b* of the porous ceramic substrate 140 by sintering with a thickness of, for example, 100 μm or less, preferably 3.0 μm to 90 μm. The glass layer 143 is formed in the same pattern as the later-described resistor pattern 142 and the electrode pattern 141 or a slightly larger pattern, and has substantially the same area as the resistor pattern 142 and the electrode pattern 141.

The resistor pattern 142 is a heating element, in which metal powder of silver, palladium, ruthenium oxide, or the like is bound by a thick film glass having a melting point below a thick film firing temperature described later, to have a thickness of 8 μm to 21 μm and a value of 1Ω to 3Ω, preferably 1.1Ω to 2.7Ω. It is a thick film resistor that is fixed on the glass layer 143 by sintering in an S-shaped pattern on the heating surface 140*b* of the porous ceramic substrate 140. The resistor pattern 142 has a pair of U-shaped portions, one end of which is connected to each other to form an S-shape. The resistor pattern 142 is formed on the heat generating surface 140*b* of the porous ceramic substrate 140 so as to have a size of 5% to 30%, preferably 13% to 21%, with respect to the entire heat generating surface 140*b*.

The pair of electrode patterns 141 have the same conductivity as that of a conductor by bonding metal powders such as aluminum, nickel, copper, silver, platinum, and gold with a thick film glass having a melting point equal to or lower than a thick film firing temperature described later. It is a thick film conductor that has a rectangular shape and is fixed on the glass layer 143 by sintering at both ends of the heat generating surface 140*b* of the porous ceramic substrate 140. The pair of electrode patterns 141 are connected to the resistor pattern 142 by overlapping the ends of the pair of U-shaped portions extending in an arc shape from the other ends to the electrode pattern 141 side. The pair of electrode patterns 141 are formed on the heat generating surface 140*b* of the porous ceramic substrate 140 so as to have a size of 5% to 20% with respect to the entire heat generating surface 140*b*.

Figure 16:
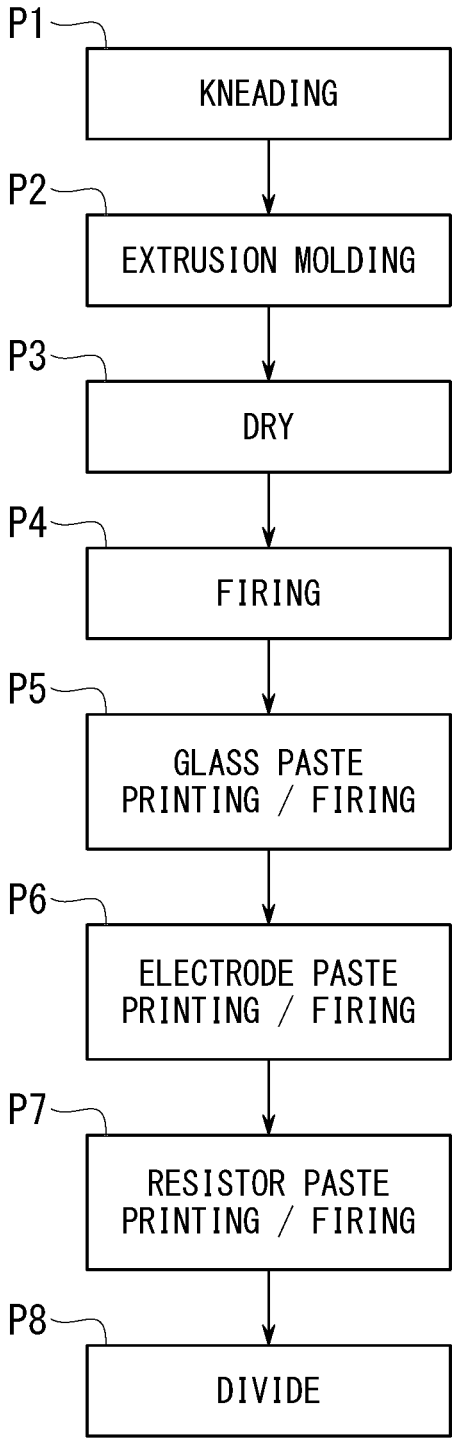
FIG. 16 is a process diagram showing a main part of a manufacturing process of the heater in FIG. 13

FIG. 16 shows the manufacturing process of the heater 104. In FIG. 16, in the kneading step P1, the material of the porous ceramic substrate 140 such as alumina powder, inorganic binder, foaming agent, organic binder, water, wax, or the like are compounded and mixed at a predetermined mixing ratio so as to have a predetermined porosity of, for example, 30% to 90%. After that, the mixture is kneaded using a kneader to obtain clay-like embryo soil. The foaming agent is, for example, resin beads. Next, in the extrusion molding step P2, the embryo soil is molded into a plate-shaped green sheet having a predetermined thickness of about 4 mm by using a vacuum extrusion molding machine. Further, a groove for division is formed on the green sheet by pressing a linear blade.

Next, the green sheet obtained in the extrusion molding step P2 is dried in the drying step P3 and then fired in the firing step P4 at a firing temperature of, for example, 1300° C. to 1500° C. Thereby, the foaming agent, the organic binder, the water, the wax, or the like in the embryo soil disappear, and at the same time, the alumina particles are bound by the inorganic binder, so that a ceramic plate in which a plurality of porous ceramic substrates 140 are connected is formed.

Next, in the glass paste printing/firing step P5, a thick film glass paste containing, for example, borosilicate glass powder, a resin binder, an organic solvent, or the like is screen-printed at a plurality of locations on the ceramic plate obtained in the firing step P4 in the pattern of the glass layer 143 shown in FIG. 13. After that, it is fired at a temperature lower than the firing temperature of the ceramic plate, for example, 800° C. to 1000° C. Thereby, the resin binder, the organic solvent, or the like in the thick film glass paste disappear, and at the same time, the borosilicate glass melts and the glass layer 143 is fixed on the ceramic plate by sintering.

In the subsequent electrode paste printing/firing step P6, for example, a thick film electrode paste containing silver (Ag) powder, a small amount of borosilicate glass, a resin binder, an organic solvent, or the like is screen-printed on the glass layer 143 at a plurality of positions on the ceramic plate obtained in the firing step P4 in the pattern of the electrode pattern 141 shown in FIG. 13. After that, the glass layer 143 is fired at a firing temperature equal to or lower than the firing temperature, for example, a thick film firing temperature of 700° C. to 900° C. Thereby, the resin binder, the organic solvent, or the like in the electrode paste, that is, the conductor paste disappears, and at the same time, the borosilicate glass is melted and the silver powder is bonded by the molten borosilicate glass, so that the electrode pattern 141 is fixed on the glass layer 143 on the ceramic plate by sintering.

Subsequently, in the resistance paste printing/firing step P7, for example, a thick film resistance paste, which includes silver-palladium (Ag—Pd) powder, borosilicate glass, a resin binder, an organic solvent, or the like and has a sheet resistance of 100 to 200 mΩ/sq for example, is screen-printed in the pattern of the resistor pattern 142 shown in FIG. 13 on each of the glass layer 143 and the electrode pattern 141 on the ceramic plate obtained in the firing step P4. After that, it is fired at a firing temperature lower than the firing temperature of the glass layer 143, for example, a thick film firing temperature of 700° C. to 900° C. Thereby, the resin binder, the organic solvent, and the like in the thick film resistor paste disappear, and at the same time, the borosilicate glass is melted and the silver-palladium powder is bonded by the molten borosilicate glass, whereby the resistor pattern 142 is fixed on the glass layer 143 and the electrode pattern 141 on the ceramic plate by sintering. The resistor pattern 142 may be formed by co-firing with the electrode pattern 141.

Then, in the dividing step P8, the ceramic plate to which the glass layer 143, the resistor pattern 142, and the electrode pattern 141 are fixed at a plurality of positions is broken along the dividing groove, so that a plurality of heaters 104 is obtained.

Below, the contents of comparative products 1, 2, 9 and example products 1 to 9 which are test samples produced by the present inventors in the same process as the process shown in FIG. 16, and the experimental results for them will be described with reference to FIGS. 17 to 21.

(Comparative Product 1)

On an alumina substrate made of a dense alumina body having a porosity of 0% by volume and having no conductivity, via a glass layer having a thickness of 20 μm, an electrode pattern having an area of 13% with respect to the heating surface, and a resistor pattern having a thickness of 10 μm and a resistance value of 2Ω and having an area of 15% with respect to the heating surface were formed similarly to that shown in FIG. 13, thereby one kind of comparative product was prepared as shown in FIG. 17.

(Comparative Products 2*a*, 2*b*)

On two kinds of substrates, an electrically conductive porous ceramic substrate having an average pore size of 3.3 μm and a porosity of 65% by volume, and a porous ceramic substrate having no electrical conductivity, without using the glass layer, an electrode pattern having an area of 13% with respect to the heat generating surface and a resistor pattern having a thickness of 10 μm and a resistance value of 2Ω and having an area of 15% with respect to the heat generating surface 140*b* were formed in the same manner as shown in FIG. 13, thereby two kinds of comparative products 2*a* and 2*b* were prepared as shown in FIG. 17.

(Example Product 1)

On a non-conductive porous ceramic substrate having a porosity of 65% by volume and an average pore size of 3.3 μm, via a glass layer having a thickness of 20 μm, an electrode pattern having an area of 13% with respect to the heat generating surface and a resistor pattern having a thickness of 10 μm and a resistance value of 2Ω and having an area of 15% with respect to the heat generating surface were formed in the same manner as shown in FIG. 13, thereby example product 1 was prepared.

(Example Products 2*a*, 2*b*, 2*c*)

On three kinds of non-conductive porous ceramic substrates having porosities of 65% by volume, 60% by volume, and 57% by volume, and an average pore size of 1.5 μm, via a glass layer having a thickness of 20 an electrode pattern having an area of 13% with respect to the heating surface and a resistor pattern having a thickness of 10 μm and a resistance value of 2Ω and having an area of 15% with respect to the heating surface were formed in the same manner as shown in FIG. 13, thereby three kinds of example products 2*a*, 2*b*, and 2*c* were prepared as shown in FIG. 17.

(Example Products 3*a*, 1, 3*b*, 3*c*, 3*d*, 3*e*)

On six kinds of non-conductive porous ceramic substrates having an average pore size of 1.5 μm, 3.3 μm, 4.2 μm, 5.1 μm, 72 μm, and 0.15 μm and a porosity of 65% by volume, via a glass layer 143 having a thickness of 20 μm, resistor patterns each having a thickness of 10 μm and a resistance value of 2Ω or 1.3Ω and having an area of 15% with respect to the heating surface were formed in the same manner as shown in FIG. 13, thereby six kinds of example products 3*a*, 1, 3*b*, 3*c*, 3*d*, 3*e* were prepared as shown in FIG. 17.

(Example Products 4*a*, 1, 4*b*, 4*c*, 4*d*, 4*e*)

On a non-conductive porous ceramic substrate having a porosity of 65% by volume and an average pore size of 3.3 μm, via six kinds of glass layers having thicknesses of 22 μm, 20 μm, 19 μm, 17 μm, 90 μm and 3 μm, an electrode pattern having an area of 13% with respect to the heat generating surface and a resistor pattern having a thickness of 10 μm and a resistance value of 2Ω and having an area of 15% with respect to the heat generating surface were respectively formed in the same manner as shown in FIG. 13, thereby six kinds of example products 4*a*, 1, 4*b*, 4*c*, 4*d*, and 4*e* were prepared as shown in FIG. 17.

(Example Products 5*a*, 5*b*, 5*c*)

On a non-conductive porous ceramic substrate having a porosity of 65% by volume and an average pore size of 3.3 μm, via a glass layer having a thickness of 20 μm, an electrode pattern with an area of 13% with respect to the heating surface, and three kinds of resistor patterns having a thickness of 8 μm, 17 μm, and 21 μm and a resistance value of 1.5Ω, and having an area of 15% with respect to the heat generating surface 140*b* were respectively formed in the same manner as shown in FIG. 13, thereby three kinds of example products 5*a*, 5*b*, and 5*c* were formed as shown in FIG. 3.

(Example Products 6*a*, 6*b*, 6*c*)

On a non-conductive porous ceramic substrate having a porosity of 65% by volume and an average pore size of 3.3 μm, via a glass layer having a thickness of 20 μm, three kinds of resistor patterns having a thickness of 17 μm and resistance values of 1.55, 2Ω and 2.7Ω were respectively formed in the same manner as shown in FIG. 13, thereby three kinds of example products 6*a*, 6*b*, and 6*c* were prepared as shown in FIG. 17.

(Example Products 7*a*, 7*b*, 7*c*, 7*d*, 7*e*, 7*f*, 7*g*)

On a non-conductive porous ceramic substrate having a porosity of 65% by volume and an average pore size of 3.3 via seven kinds of glass layers having a thickness of 20 μm and width dimensions of 133%, 167%, 200%, 233%, 267%, 300%, and 100% with respect to the width of the resistor pattern, respectively, resistor patterns having a thickness of 10 μm and a resistance value of 1.3Ω were respectively formed in the same manner as shown in FIG. 13, thereby seven kinds of example products 7*a*, 7*b*, 7*c*, 7*d*, 7*e*, 7*f*, and 7*g* were prepared as shown in FIG. 17.

(Example Product 8)

On a conductive porous ceramic substrate having a porosity of 65% by volume and an average pore size of 3.3 μm, via a glass layer having a thickness of 20 μm, an electrode pattern having an area of 13% with respect to the heat generating surface and a resistor pattern having a thickness of 10 μm and a resistance value of 2Ω and having an area of 15% with respect to the heat generating surface were formed in the same manner as shown in FIG. 13, thereby one kind of example product 8 was prepared as shown in FIG. 17.

(Example Products 9*a*, 9*b*, 9*c*, 9*d*, 9*e*, and Comparative Product 9)

On a porous ceramic substrate having porosity and average pore size of 66% by volume and 26 μm, 40% by volume and 9.8 μm, 65% by volume and 4.0 μm, 66% by volume and 4.1 μm, 71% by volume and 13 μm, 38% by volume and 1.1 μm, and having no conductivity, via glass layers each having a thickness of 20 μm and a width of 133% with respect to the electrode pattern, six kinds of resistor patterns each having a thickness of 10 μm and resistance values of 1.3Ω, 1.1Ω, 1.4Ω, 1.4Ω, 1.3Ω, 1.4Ω were formed in the same as those shown in FIG. 13, thereby five kinds of example products 9*a*, 9*b*, 9*c*, 9*d*, 9*e* and a comparative product 9 were prepared as shown in FIG. 18.

(Glass Layer Thickness Measurement)

The cross-sectional shape (profile) of the glass layer 143 in the width direction is measured by using a laser microscope, and the average height difference from the surface of the porous ceramic substrate 140 at the central portion 50% with respect to the total width dimension in the cross-sectional shape was calculated as the thickness of the glass layer.

(Measurement of Atomization Characteristics)

Aerosol source: Glycerin 45%, Propylene glycol 45%, Distilled water 10% mixture

Measurement method: The lower surface of each test product was brought into contact with cotton impregnated with an aerosol source, and in this state, the aerosol source from the top of the heating element was atomized by applying 21 joules of electrical energy to the resistor pattern by one heating cycle including a period for applying a voltage for 3 seconds between a pair of electrode patterns and a rest period for the voltage application for 27 seconds. Thereby, the weight reduction amount of the cotton when atomization is performed for five heating cycles was measured, and the weight reduction amount per one heating cycle, that is, the atomization amount was calculated.

(Durability Evaluation Method)

After the heating cycle performed for the measurement of the atomization characteristics is repeated 100 times, the presence or absence of peeling of the glass layer, the resistor pattern, and the electrode pattern on the porous ceramic substrate is inspected using an 80× stereoscopic microscope. Thereby, the presence or absence of peeling was judged, and those without peeling were evaluated as good, and those with peeling were evaluated as bad.

(Measurement of Porosity)

The porosity of the ceramic substrate was measured by the Archimedes method. The porosity P was calculated by measuring the saturated water weight Waw, the dry weight Wair, and the water weight Waq, respectively, and substituting them from the following equation (1) representing the porosity P.

$$P=(Waw-Wair)/(Waw-Way) \quad (1)$$

(Measurement of the Tortuosity Coefficient)

Measurement method: The pore volume V, total pore volume Vco, pore size r, and bulk density $\rho_{Hg}$ of each test product (porous ceramic substrate) were measured using a mercury porosimeter, and the BET specific surface area S was measured using a gas adsorption method in which the specific surface area of a test product is calculated based on the adsorption amount of gas molecules whose adsorption occupation area is known. The bending degree coefficient τ is calculated based on the following equation (2).

$$\tau=(2.23-1.13\ Vco\ \rho_{Hg})(0.92\ y)^{1+E} \quad (2)$$

Here, $y=(4/S)\Sigma(\Delta Vi/ri)$

In FIG. 17 and FIG. 18, the range satisfying the criteria required for the product, for example, satisfying both the atomization amount of 3 mg or more and the absence of peeling in 100 heating cycles was that the porosity of the porous ceramic substrate is 40% to 71% by volume, the average pore size of the porous ceramic substrate is 0.15 μm to 72 μm, the ratio of the width of the glass layer to the width dimension of the resistor pattern was 100% to 300%, and glass layer thickness was 3.0 μm to 90 μm.

Figure 19:
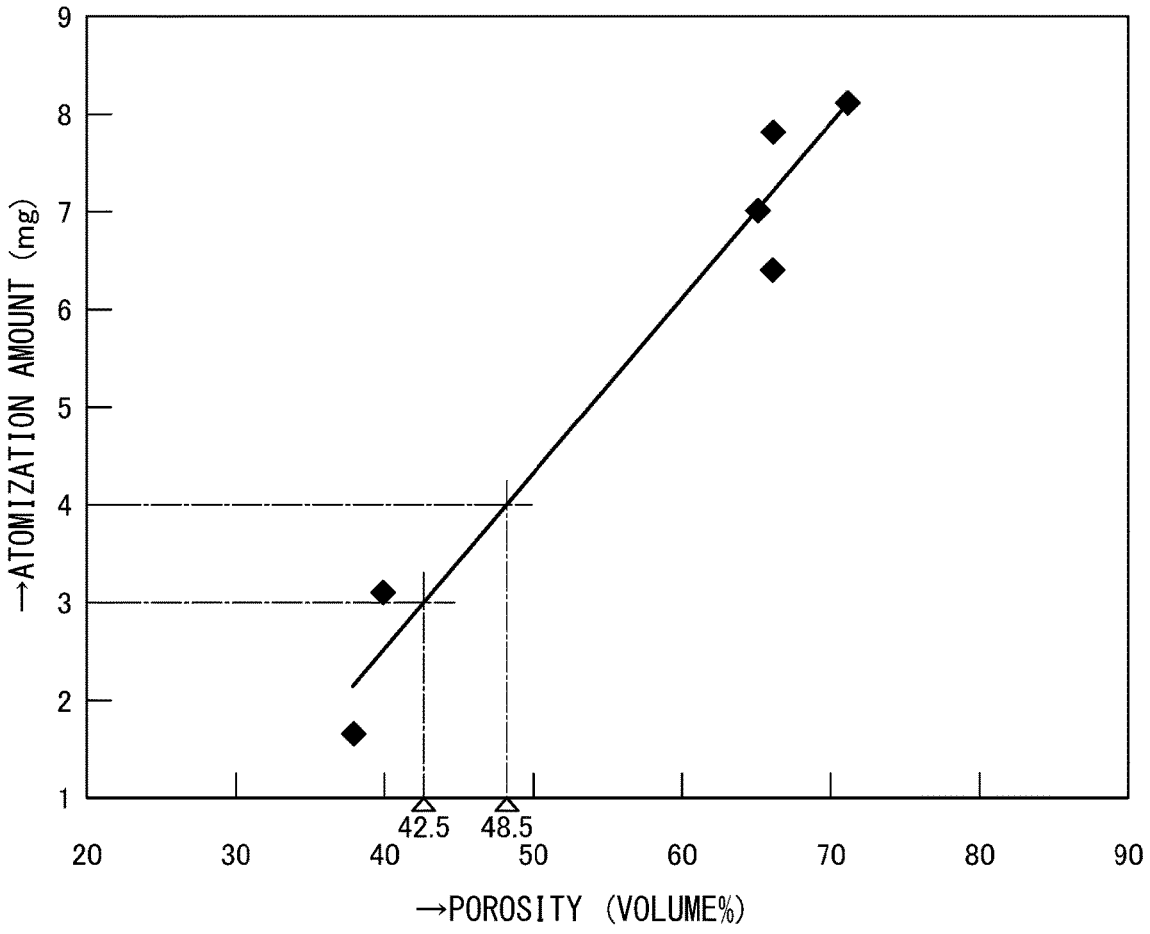
FIG. 19 is a graph showing the relationship between the porosity and the atomization amount, which is derived from the data shown in FIG. 18.
Figure 20:
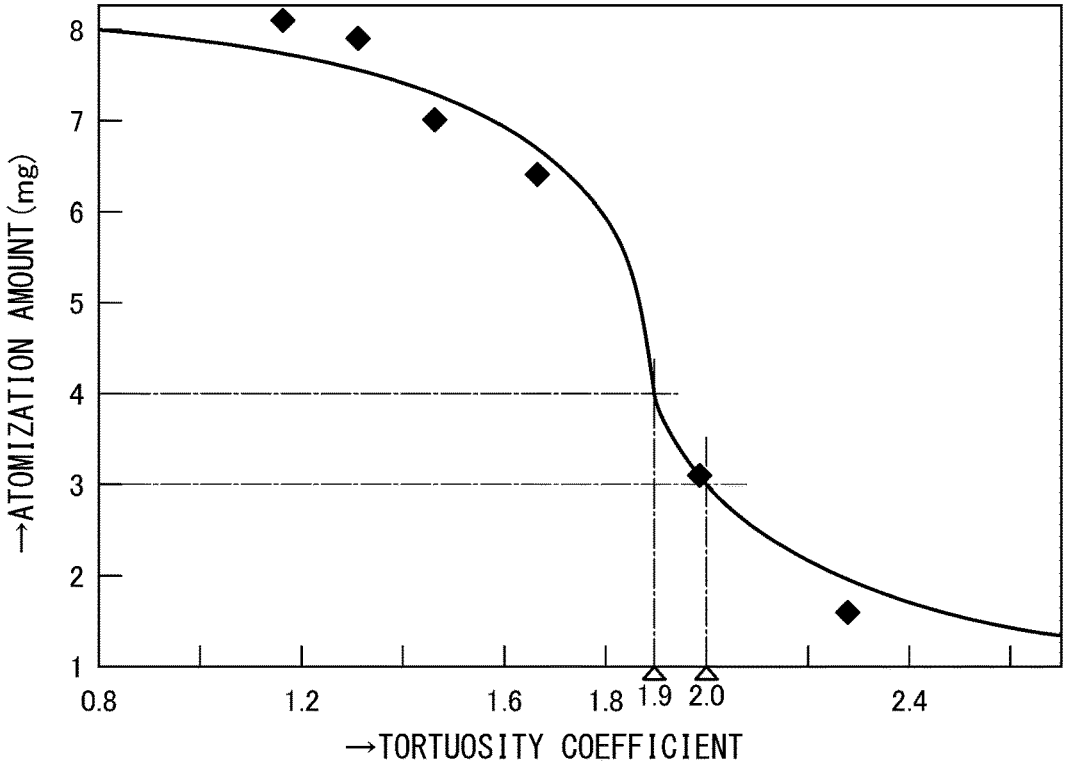
FIG. 20 is a graph showing the relationship between the degree of curvature and the atomization amount, which is derived from the data shown in FIG. 18.
Figure 21:
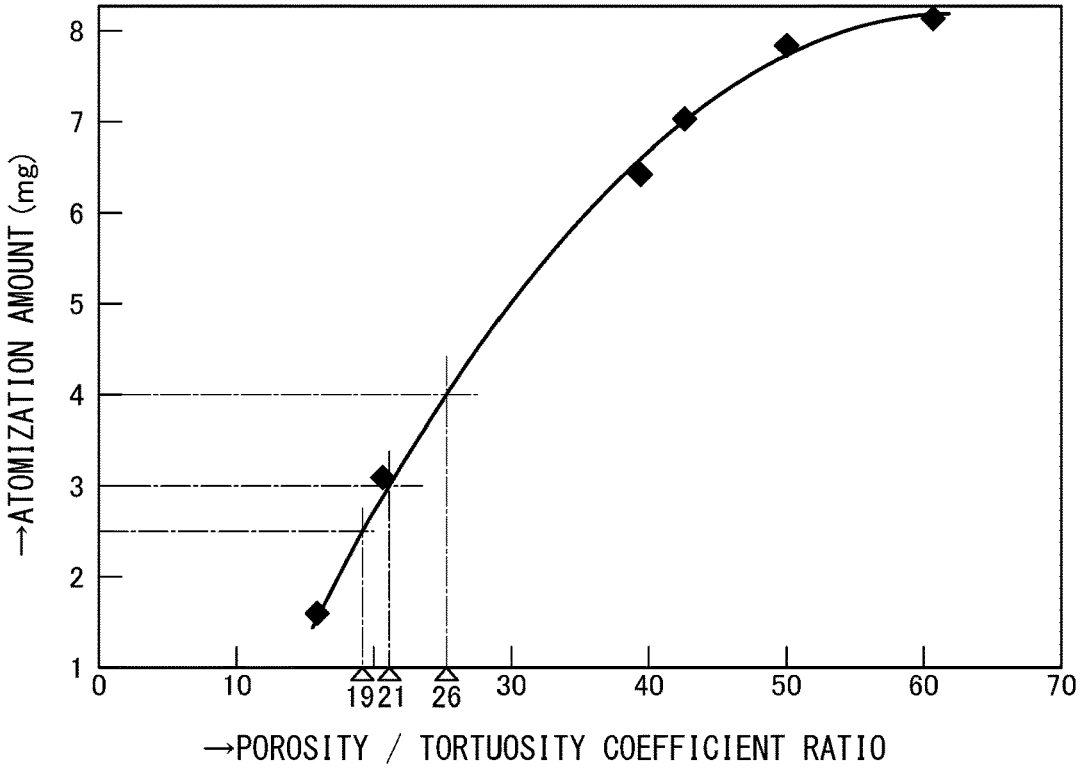
FIG. 21 is a graph showing the relationship between the ratio of porosity to tortuosity and the atomization amount, which is derived from the data shown in FIG. 18.

Further, from the data shown in FIG. 18, as shown in FIGS. 19 and 20, the relationship between the atomization amount and the porosity, and the relationship between the atomization amount and the tortuosity coefficient were closely related to each other. Also, a close correlation is obtained between the atomization amount and the ratio of porosity to tortuosity as shown in FIG. 21. In a case in which the standard of the amount of atomization obtained for the product is 2.5 mg or more and the ratio of porosity to tortuosity is 19 or more, the standard of the amount of atomization is satisfied. Further, in a case in which the standard of the atomization amount obtained for the product is 3 mg or more and the ratio of porosity to tortuosity is 21 or more, the standard of the atomization amount is satisfied. More preferably, the ratio of porosity to tortuosity is 26 or more.

According to the heater 104 of this embodiment, the resistor pattern 142 is provided on the glass layer 143. A glass layer 143 and a pair of electrode patterns 141 connected to the resistor pattern 142 are provided on the heating surface 140*b* of the porous ceramic substrate 140. In the heater 104, the resistor pattern 142 generates heat by supplying a current between the pair of electrode patterns 141. The ratio of porosity to tortuosity of the porous ceramic substrate 140 is 21 or more. The glass layer 143 is provided on at least a surface of the heat generation surface of the porous ceramic substrate 140, which is below the resistor pattern 142. The aerosol source that has infiltrated into the porous ceramic substrate 140 is atomized from the surface of the heating surface 140*b* of the porous ceramic substrate 140 that is not covered by the glass layer 143 by heating the resistor pattern 142. Therefore, since the porous ceramic substrate 140 does not need conductivity, there is no limitation on the material and the substrate material selectivity is high. Also, by selecting a porous ceramic substrate material according to the application, it is possible to achieve both chemical resistance to an aerosol source and mechanical strength. In addition, the resistor pattern 142 is formed on the heat generating surface 140*b*, which is one surface of the porous ceramic substrate 140, via the glass layer 143 formed in a part of the heat generating surface 140*b* including at least the resistor pattern 142. Thereby, the thermal shock resistance and adhesive strength of the resistor pattern 142 functioning as an electric resistance heating element can be obtained, and high atomization efficiency and high durability performance can be obtained.

According to the heater 104 of this embodiment, the ratio of porosity to tortuosity of the porous ceramic substrate 140 is 26 or more. Thereby, since the porous ceramic substrate 140 has pores having a high porosity and a small bend, high atomization performance can be obtained. In a case in which the ratio of porosity to tortuosity is less than 26, the porosity may be too low or the bending of the pores may be large, resulting in insufficient infiltration of the aerosol source, which may result in insufficient atomization performance.

Further, according to the heater 104 of this embodiment, the porous ceramic substrate 140 has an average porosity of 40% by volume or more and 71% by volume or less. This facilitates the infiltration of the aerosol source into the porous ceramic substrate 140, so that the atomization efficiency of the aerosol source, that is, the atomization performance is improved. In a case in which the porosity of the porous ceramic substrate 140 exceeds 70% by volume, the durability of the heater 104 may not be sufficiently obtained due to peeling of the glass layer 143, the resistor pattern 142, or the electrode pattern 141. In a case in which the porosity is less than 41.5% by volume, the atomization performance may not be sufficiently obtained.

According to the heater 104 of this embodiment, the tortuosity coefficient of pores of the porous ceramic substrate 140 is 2.0 or less. Thereby, since the heater 104 has pores with a small bend, high atomization performance can be obtained. In a case in which the tortuosity coefficient exceeds 2.0, the infiltration resistance of the aerosol source increases, the infiltration of the aerosol source becomes insufficient, and the atomization performance may not be sufficiently obtained.

According to the heater 104 of this embodiment, the porous ceramic substrate 140 has an average pore size of 0.15 μm or more and 72 μm or less. This facilitates the infiltration of the aerosol source into the porous ceramic substrate 140 by the capillary action, so that the atomization efficiency of the aerosol source, that is, the atomization performance is improved. In a case in which the average pore size is less than 0.15 nm, the infiltration resistance of the aerosol source may increase and the infiltration of the aerosol source may be insufficient. In a case in which the average pore size exceeds 26 nm, the capillary force due to the capillary phenomenon decreases. Thereby, the infiltration of the aerosol source may be insufficient, and the atomization performance may not be sufficiently obtained.

According to the heater 104 of this embodiment, the glass layer 143 has a thickness of 3 μm to 90 μm. In a case in which the thickness of the glass layer 143 is less than 3 μm, the resistance value of the resistor pattern varies and the manufacturing yield decreases, and in a case in which it exceeds 90 μm, the heat conduction from the resistor pattern 142 to the porous ceramic substrate 140 decreases, and atomization performance may not be obtained sufficiently.

According to the heater 104 of the present embodiment, the glass layer 143 is made of a sintered body of a thick film glass paste provided on the heating surface 140*b* which is one surface of the porous ceramic substrate 140. The resistor pattern 142 is made of a sintered body of a thick film resistor paste provided on the glass layer 143, and the electrode pattern 141 is made of a sintered body of a thick film conductive paste provided on the glass layer 143. Thereby, on one surface of the porous ceramic substrate 140, a glass layer 143 having a thickness of 3 μm to 90 μm and a resistor pattern 142 and an electrode pattern 141 on the glass layer 143 are formed by a thick film. Therefore, thermal shock resistance and adhesive strength are obtained, and durability is obtained. In a case in which the thickness of the glass layer 143 is less than 3 μm, the resistance value of the resistor pattern 142 varies and the manufacturing yield decreases, and in a case in which it exceeds 90 μm, the heat conduction from the resistor pattern 142 to the porous ceramic substrate 140 decreases and the atomization performance may not be sufficiently obtained.

According to the heater 104 of the present embodiment, the porous ceramic substrate 140 contains alumina, zirconia, mullite, silica, titania, silicon nitride, silicon carbide, or carbon as a main component. The resistor pattern 142 is a thick film sintered body containing metal powder of any one of silver, palladium and ruthenium oxide and glass. The electrode pattern 141 is a thick film sintered body containing glass and metal powder of any one of copper, nickel, aluminum, silver, platinum, and gold. The glass layer 143 is a thick film sintered body containing any of Ba, B, and Zn. The glass layer 143, and the resistor pattern 142 and the electrode pattern 141 on the glass layer 143 are formed by the thick film sintered body on the heat generating surface 140*b* which is one surface of the porous ceramic substrate 140. Therefore, thermal shock resistance and adhesive strength are obtained, and durability is obtained.

According to the heater 104 of the present embodiment, the heating surface 140*b*, which is one surface of the porous ceramic substrate 140, is a longitudinal-shape surface, and the pair of electrode patterns 141 are arranged at both ends of the longitudinal-shape surface. In the resistor pattern 142, one ends of a pair of U-shaped portions are connected to each other, and the ends extending in an arc shape from the other end to the electrode pattern 141 side are connected to each of the pair of electrode patterns 141. In this way, the resistor pattern 142 has a shape in which one end of the pair of U-shaped portions is connected to each other and the other end is connected to each of the pair of electrode patterns 141, so that heat is locally concentrated and the entire resistor pattern 142 uniformly generates heat, thereby atomization efficiency of the aerosol source, that is, atomization performance is improved.

Although the preferred embodiment of the present invention has been described in detail with reference to the drawings, the present invention is not limited to this and can be implemented in still another embodiment.

For example, in the above embodiments, the aerosol source is a mixed liquid of glycerin, propylene glycol, and distilled water in a ratio of 5:5:1, but other ratios may be used, and other liquids such as fragrances may be further added.

Further, in the above-described embodiment, the resistor pattern 142 has a resistance value of about 1Ω or more and 3Ω or less, but it may be changed to another body in relation to power transmission.

Further, although the resistor pattern 142 of the above-described embodiment is an S-shaped pattern, it may be a pattern of another shape such as a sine wave pattern or a rectangular pattern.

Further, in the above-described embodiment, the glass layer 143 is formed in the same pattern as the resistor pattern 142 and the electrode pattern 141 or a slightly larger pattern, but it is not necessarily the same pattern as the resistor pattern 142 and the electrode pattern 141. It may be a pattern larger than and different from the resistor pattern 142 and the electrode pattern 141 as long as the atomization performance of atomizing the aerosol source is satisfied and the resistor pattern 142 can be supported.

Further, although the pair of electrode patterns 141 is formed on the glass layer 143 at both ends of the heat generating surface 140*b* of the porous ceramic substrate 140, the pair of electrode patterns 141 need not necessarily be at both ends. Moreover, the electrode pattern 141 does not necessarily have to be formed on the glass layer 143.

Further, in the above-described embodiment, the glass layer 143, the resistor pattern 142, and the electrode pattern 141 are made of thick films on the heat-generating surface 140*b* of the porous ceramic substrate 140, but at least one of the resistor pattern 142 and the electrode pattern 141 may be formed of a thin film using sputtering.

In addition, although not illustrated one by one, the present invention is implemented with various modifications within a range not departing from the spirit thereof.

For example, although the case where the glass layer 143 is provided in the heater 104 of the present embodiment has been described, a ceramic layer may be provided instead of the glass layer 143. That is, a thin film such as a glass layer or a ceramic layer may be provided.

The non-combustion suction device may include: a power supply; a container configured to accommodate an aerosol source; a heater configured to atomize the aerosol source into an aerosol; and a mouthpiece formed with a suction port configured to suck the aerosol. The heater may include: a porous ceramic substrate; a resistor pattern; and a pair of electrode patterns connected to each other through the resistor pattern. The heater may be configured to cause the resistor pattern to generate heat by supplying a current between the pair of electrode patterns. The ratio of porosity to tortuosity of the porous ceramic substrate may be 21 or more. The heater may further include a glass layer on at least a part of the porous ceramic substrate, and the resistor pattern may be provided on the glass layer. The aerosol source that has infiltrated into the porous ceramic substrate may be heated by the resistor pattern and is discharged as the aerosol.

It is possible to provide a non-combustion suction device that can obtain high atomization efficiency and high durability.

What is claimed is:

1. A non-combustion suction device, comprising:

a mouthpiece having a suction port;

a container configured to accommodate an aerosol source; and a heater including:

a porous ceramic substrate that permits infiltration of the aerosol source;

a glass layer at least in part on the porous ceramic substrate;

a pair of electrode patterns; and a resistor pattern on the glass layer, the resistor pattern connects the pair of electrode patterns to each other; and a power source connected to the pair of electrode patterns, wherein the power source is configured to supply a power flow through the pair of electrode patterns to cause the resistor pattern to generate heat which atomizes, into an aerosol, the aerosol source infiltrated in the porous ceramic substrate, the porous ceramic substrate has a ratio of porosity to tortuosity of 21 or more, the glass layer is composed of a sintered body of a film glass paste on the porous ceramic substrate, the resistor pattern is composed of a sintered body of a film resistor paste on the glass layer, and the electrode pattern is made of a sintered body of a film conductive paste provided on the glass layer.

2. The non-combustion suction device according to claim 1, wherein the porous ceramic substrate contains at least one of alumina, zirconia, silica, titania, silicon nitride, silicon carbide, and carbon, as a main component, the resistor pattern is a film sintered body containing glass, and a metal powder of at least one of silver, palladium, and ruthenium oxide, and, the electrode pattern is a film sintered body containing glass, and a metal powder of at least one of copper, nickel, aluminum, silver, platinum, and gold, and the glass layer is a film sintered body containing at least one of barium, boron, and zinc.

3. The non-combustion suction device according to claim 1, wherein the ratio of porosity to tortuosity of the porous ceramic substrate is 26 or more.

4. The non-combustion suction device according to claim 1, wherein the porous ceramic substrate has an average porosity of 40% by volume to 71% by volume.

5. The non-combustion suction device according to claim 1, wherein a tortuosity coefficient of pores of the porous ceramic substrate is 2.0 or less.

6. The non-combustion suction device according to claim 1, wherein the porous ceramic substrate has an average pore size of 0.15 μm to 72 μm.

7. The non-combustion suction device according to claim 1, wherein the glass layer has a thickness of 3 μm to 90 μm.

8. The non-combustion suction device according to claim 1, wherein a surface of the porous ceramic substrate is a longitudinal-shape surface, the pair of electrode patterns are arranged at both ends of the longitudinal-shape surface, and in the resistor pattern, first ends of a pair of U-shaped arcs are connected to each other and each of second ends of the pair of U-shaped arcs is connected to each of the pair of electrode patterns.

9. The non-combustion suction device according to claim 1, wherein the suction port includes a flavor source container.

10. The non-combustion suction device according to claim 4, wherein the flavor source container contains a tobacco component.

* * * * *